US011398701B2

(12) United States Patent
Hayashi

(10) Patent No.: US 11,398,701 B2
(45) Date of Patent: Jul. 26, 2022

(54) WAFER CONNECTOR AND FITTING CONNECTOR

(71) Applicant: 3M INNOVATIVE PROPERTIES COMPANY, St. Paul, MN (US)

(72) Inventor: Tatsuya Hayashi, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/949,311

(22) Filed: Oct. 26, 2020

(65) Prior Publication Data

US 2021/0159638 A1 May 27, 2021

(30) Foreign Application Priority Data

Nov. 22, 2019 (JP) ..... JP2019-211791

(51) Int. Cl.
*H01R 13/514* (2006.01)
*H01R 13/627* (2006.01)
(Continued)

(52) U.S. Cl.
CPC ..... *H01R 13/6272* (2013.01); *H01R 12/716* (2013.01); *H01R 12/75* (2013.01); *H01R 13/50* (2013.01); *H01R 25/006* (2013.01)

(58) Field of Classification Search
CPC .... H01R 13/6272; H01R 13/50; H01R 12/75; H01R 25/006; H01R 12/716; H01R 13/633; H01R 13/514
See application file for complete search history.

(56) References Cited

U.S. PATENT DOCUMENTS 5,320,555 A * 6/1994 Okabe ..... H01R 13/6272 439/354
5,380,220 A * 1/1995 Okabe ..... H01R 13/506 439/456
(Continued)

FOREIGN PATENT DOCUMENTS

JP 10041040 2/1998
JP 10074541 3/1998
(Continued)

OTHER PUBLICATIONS

"3M™ Mini-Clamp Connectors", 3M Electronic Solutions Division Interconnect Products, [retrieved from the internet on Dec. 22, 2020], URL <https://multimedia.3m.com/mws/media/509156O/mini-clamp-sales-sheet.pdf?&aEVuQEcuZgVs6EVs6E666666-->, 2008, pp. 1-2.
(Continued)

*Primary Examiner* — Abdullah A Riyami
*Assistant Examiner* — Nelson R. Burgos-Guntin
(74) *Attorney, Agent, or Firm* — Robert S. Moshrefzadeh

(57) ABSTRACT

To provide a connector assembly and a fitting connector capable of improving workability of insertion and removal. In the wafer connector according to one embodiment, in a case where the first wafer connector is stacked with the second wafer connector including the second flexible arm, when the first flexible arm moves between the latch engagement position and the latch disengagement position in a state where the first engaging portion of the first wafer connector is engaged with the engaging portion of the second wafer connector, the second flexible arm also moves between the latch engagement position and the latch disengagement position.

12 Claims, 13 Drawing Sheets

(51) Int. Cl.

| | |
|---|---|
| ***H01R 13/50*** | (2006.01) |
| ***H01R 12/75*** | (2011.01) |
| ***H01R 25/00*** | (2006.01) |
| ***H01R 12/71*** | (2011.01) |

(56) References Cited

U.S. PATENT DOCUMENTS

| | | | | |
|---|---|---|---|---|
| 6,000,971 | A | 12/1999 | Hatagishi | |
| 6,007,386 | A * | 12/1999 | Okabe | H01R 13/42 439/701 |
| 6,352,452 | B1 * | 3/2002 | Jimenez | H01R 13/514 439/680 |
| 6,394,839 | B2 * | 5/2002 | Reed | H01R 13/6593 439/497 |
| 6,524,135 | B1 * | 2/2003 | Feldman | H01R 9/2408 439/607.46 |
| 6,857,899 | B2 * | 2/2005 | Reed | H01R 13/6593 439/497 |
| 7,108,522 | B2 * | 9/2006 | Verelst | H01R 13/6583 439/108 |
| 7,354,318 | B2 | 4/2008 | Murakami | |
| 7,572,154 | B2 * | 8/2009 | Ichio | H01R 13/4361 361/735 |
| 8,876,537 | B2 * | 11/2014 | Katsuse | H01R 13/506 439/76.2 |
| 8,911,255 | B2 * | 12/2014 | Scherer | H01R 13/6463 439/607.07 |
| 8,915,758 | B2 * | 12/2014 | Shishikura | H01R 13/514 439/701 |
| 8,936,474 | B2 * | 1/2015 | Katsuse | H01R 13/6273 439/76.2 |
| 9,071,001 | B2 * | 6/2015 | Scherer | H01R 13/516 |
| 9,246,286 | B2 * | 1/2016 | Stowers | H01R 13/502 |
| 9,685,727 | B2 * | 6/2017 | Stowers | H01R 13/514 |
| 9,972,938 | B2 * | 5/2018 | Imai | H01R 13/639 |
| 11,108,174 | B2 * | 8/2021 | Hayashi | H01R 9/2408 |
| 2003/0040203 | A1 * | 2/2003 | Kuroda | H01R 43/24 439/98 |
| 2012/0225576 | A1 * | 9/2012 | Kida | H01R 13/641 439/345 |
| 2013/0183842 | A1 * | 7/2013 | Shishikura | H01R 13/447 439/147 |
| 2013/0237068 | A1 * | 9/2013 | Katsuse | H01R 9/223 439/76.2 |
| 2015/0087175 | A1 * | 3/2015 | Stowers | H01R 13/518 439/284 |
| 2020/0212607 | A1 * | 7/2020 | Hayashi | H01R 13/6272 |
| 2021/0159638 | A1 * | 5/2021 | Hayashi | H01R 12/716 |
| 2021/0167539 | A1 * | 6/2021 | Song | H01R 13/502 |
| 2021/0234291 | A1 * | 7/2021 | Zerebilov | H01R 12/53 |

FOREIGN PATENT DOCUMENTS

| | | |
|---|---|---|
| JP | 10079273 | 3/1998 |
| JP | 2000133336 | 5/2000 |
| JP | 2004335218 | 11/2004 |
| JP | 2011134571 | 7/2011 |

OTHER PUBLICATIONS

Molex, "SL Modular Connectors", [retrieved from the internet on Dec. 22, 2020], URL <http://www.molex.com/molex/products/family/sl_connectors>, 2020, pp. 1-7.

* cited by examiner

WAFER CONNECTOR AND FITTING CONNECTOR

TECHNICAL FIELD

One aspect of the present disclosure relates to a wafer connector and a fitting connector.

BACKGROUND

In the related art, various types of stacked type wafer connectors and fitting connectors are known. Patent Document 1 describes a multi-stage connector including a first housing, a second housing, and a cover. In the multi-stage connector, the first housing, the second housing, and the cover enter box-like mating connector in a state where the first housing, the second housing, and the cover are stacked on each other. The cover includes a lock piece to be engaged with the mating connector, and the multi-stage connector is fitted to the mating connector by engagement of the lock piece of the cover.

CITATION LIST

Patent Documents

[Patent Document 1] JP 10-79273 A

SUMMARY

Technical Problem

Incidentally, regarding a stack type wafer connector such as the multi-stage connector described above, enhancement in operability of insertion and removal has been demanded. However, in the above-described multi-stage connector, since the cover, instead of the first housing and the second housing, engages with the mating connector, the mating connector cannot be fitted unless the cover is attached to the second housing. In the multi-stage connector described above, the first housing or the second housing alone cannot be inserted into or removed from the mating connector, and the cover is always required to perform such insertion and removal. Also in this respect, operation of insertion and removal cannot be performed easily. Accordingly, there is a need for a wafer connector and a fitting connector that can improve the workability of insertion and removal.

Solution to Problem

A wafer connector according to one aspect of the present disclosure is a wafer connector of a stacked type configured to be electrically fitted to a fitting connector, and includes a wafer with an electrical insulation, defining a cavity configured to receive a terminal in the wafer, a latch engaging member including an engaging portion, being integrally formed with the wafer, and including a flexible arm configured to move between a latch engagement position at which the wafer connector is latch-engaged to the fitting connector and a latch disengagement position at which the wafer connector is unlatched from the fitting connector. In a case where a first wafer connector is stacked with a second wafer connector including a second latch engaging member including a second flexible arm, when the first flexible arm moves between the latch engagement position and the latch disengagement position in a state where the first engaging portion of the first wafer connector is engaged with the second engaging portion of the second wafer connector, the second flexible arm also moves between the latch engagement position and the latch disengagement position.

A fitting connector according to one aspect of the present disclosure defines a plurality of receiving cavities configured to receive a plurality of wafer connectors, and includes an engaged portion configured to engage with a latch portion of the wafer connector received in each of the receiving cavities. The wafer connector is configured to be unlatched from the fitting connector by moving the latch portion by a disengagement distance, and for two of the wafer connectors received in each of at least the first receiving cavity and the second receiving cavity among the plurality of receiving cavities, the first disengagement distance when the latch portion of the first wafer connector is moved in the first receiving cavity is different from the second disengagement distance when the latch portion of the second wafer connector is moved in the second receiving cavity.

Advantageous Effects of Invention

According to one aspect of the present disclosure, it is possible to improve workability of insertion and removal.

DETAILED DESCRIPTION

Figure 1:
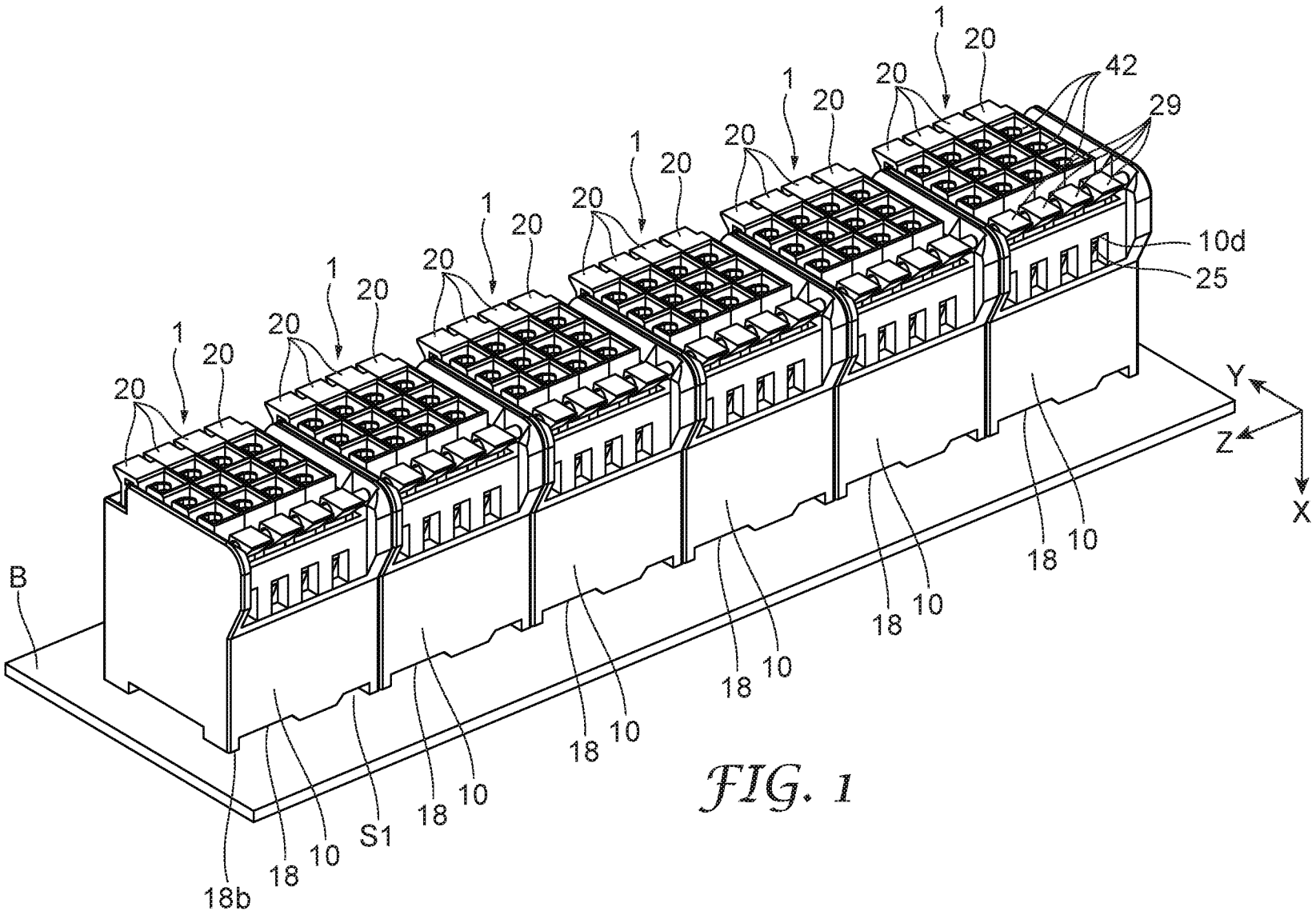
FIG. 1 is a perspective view illustrating an example of a state in which a plurality of fitting connectors to which a plurality of wafer connectors according to an embodiment are fitted are arranged on a board.

Hereinafter, embodiments of a stacked type wafer connector and a fitting connector according to the present disclosure will be described with reference to the drawings. In the description of the drawings, the same or corresponding elements are denoted by the same reference signs, and redundant description will be appropriately omitted. Some of the drawings may be simplified or exaggerated for ease of understanding, and the dimensional ratios or the like are not limited to those illustrated in the drawings.

First, a connector assembly 1 including a stacked type wafer connector and a fitting connector according to the present embodiment will be described with reference to FIG. 1. As illustrated in FIG. 1, for example, the connector assembly 1 is disposed on the board B, and the plurality of connector assemblies 1 are disposed on the board B so as to be arranged along one direction. The plurality of connector assemblies 1 may be disposed in arrangement of a lattice pattern, for example, and the arrangement of the connector assemblies 1 is not particularly limited. The connector assembly 1 includes a fitting connector 10 mounted on a board B and a plurality of stacked type wafer connectors 20 housed in the fitting connector 10. For example, the fitting connector 10 is a board-mounted connector to be mounted on the board B, and the wafer connector 20 is a stacked type wire mount wafer connector.

For example, the fitting connector 10 has a box shape, and a plurality of stacked type wafer connectors 20 can be fitted to (inserted into and removed from) the box-shaped fitting connector 10. As an example, the fitting connector 10 has a bottomed box shape including a bottom. Each wafer connector 20 has, for example, a plate shape, and is fitted to the fitting connector 10 in a state where a plurality of stacked type wafer connectors 20 are stacked in the thickness direction of the wafer connector 20.

In the following description, the fitting direction of the wafer connector 20 to the fitting connector 10 may be referred to as a direction in which the X-axis extends (X-axis direction), a direction in which the plurality of wafer connectors 20 are arranged in the fitting connector 10 may be referred to as a direction in which the Z-axis extends (Z-axis direction), and a lateral direction intersecting (e.g., orthogonal to) both the X-axis and the Z-axis may be referred to as a direction in which the Y-axis extends (Y-axis direction). In addition, a direction in which the connector assembly 1 is viewed from the board B may be referred to as an upper direction, and a direction in which the board B is viewed from the connector assembly 1 may be referred to as a lower direction. For example, the X-axis direction coincides with the thickness direction of the board B and the direction in which the board B and the connector assembly 1 are arranged. The Y-axis direction coincides with, for example, a direction in which channels 42 (to be described later) of each wafer connector 20 are arranged. The Z-axis direction coincides with, for example, a direction in which the plurality of fitting connectors 10 are arranged or a direction in which the plurality of wafer connectors 20 are stacked.

Figure 2:
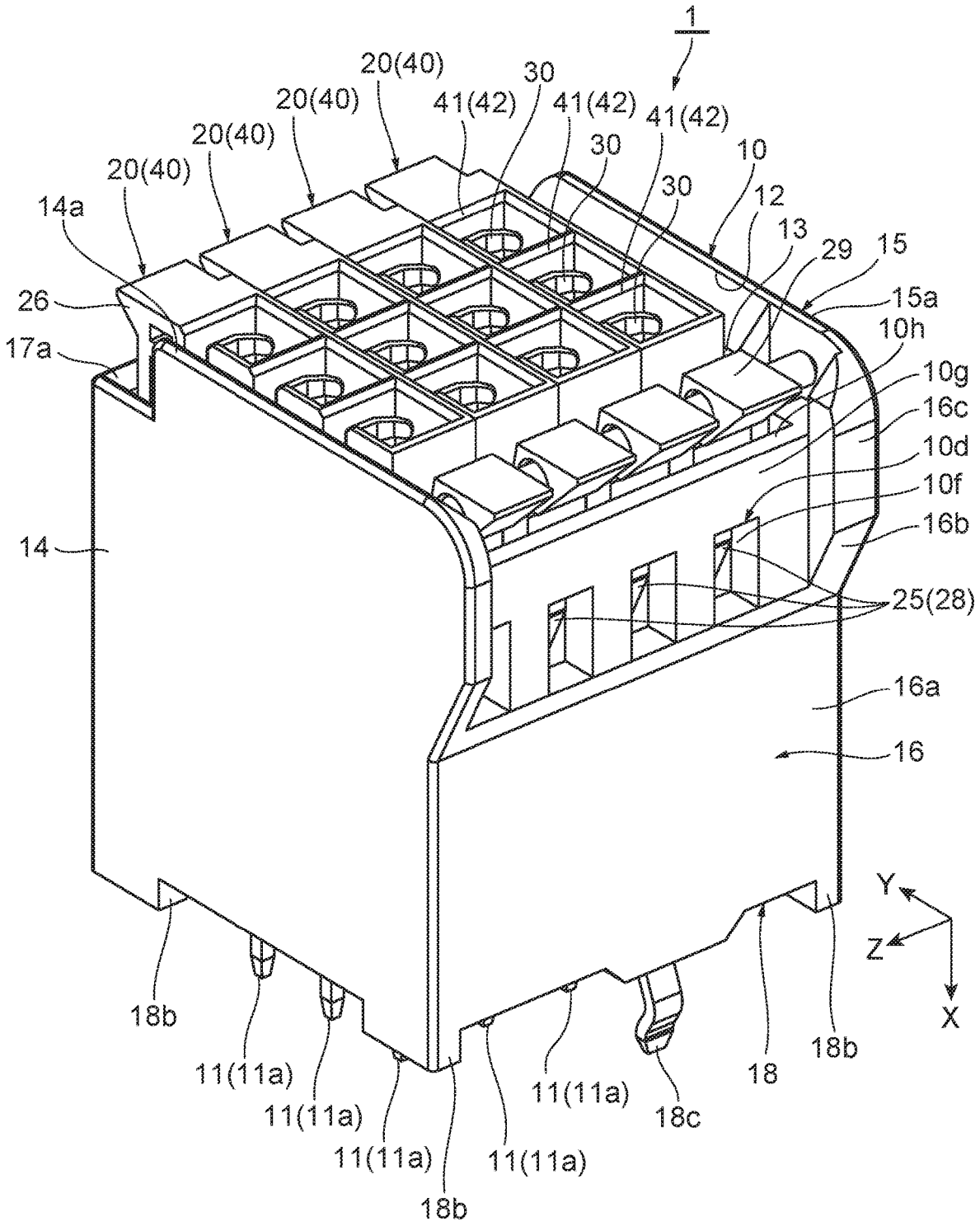
FIG. 2 is a perspective view illustrating a stacked type wafer connector and fitting connector according to an embodiment.
Figure 3:
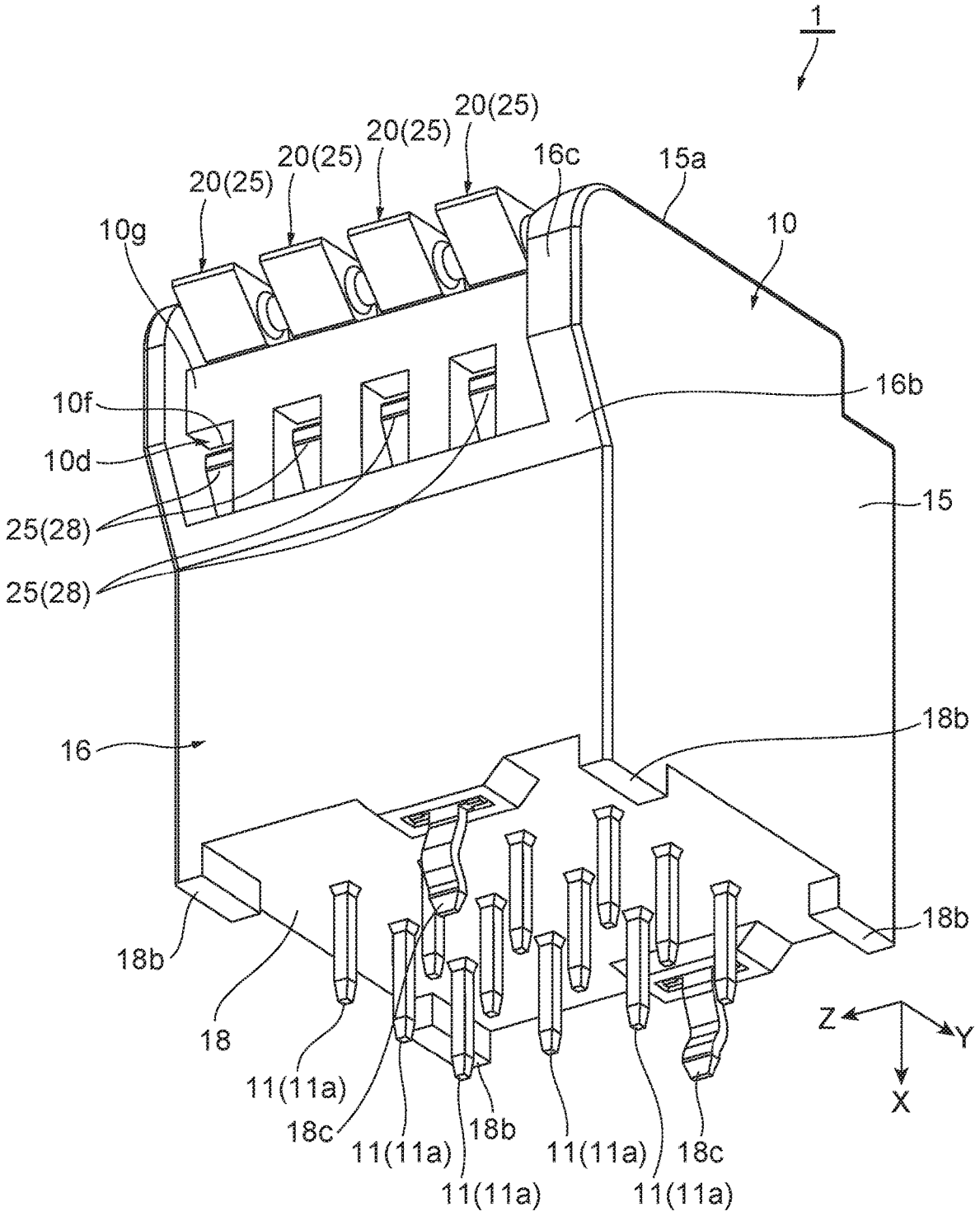
FIG. 3 is a perspective view of the stacked type wafer connector and fitting connector of FIG. 2 as viewed from a direction different from that of FIG. 2.
Figure 4:
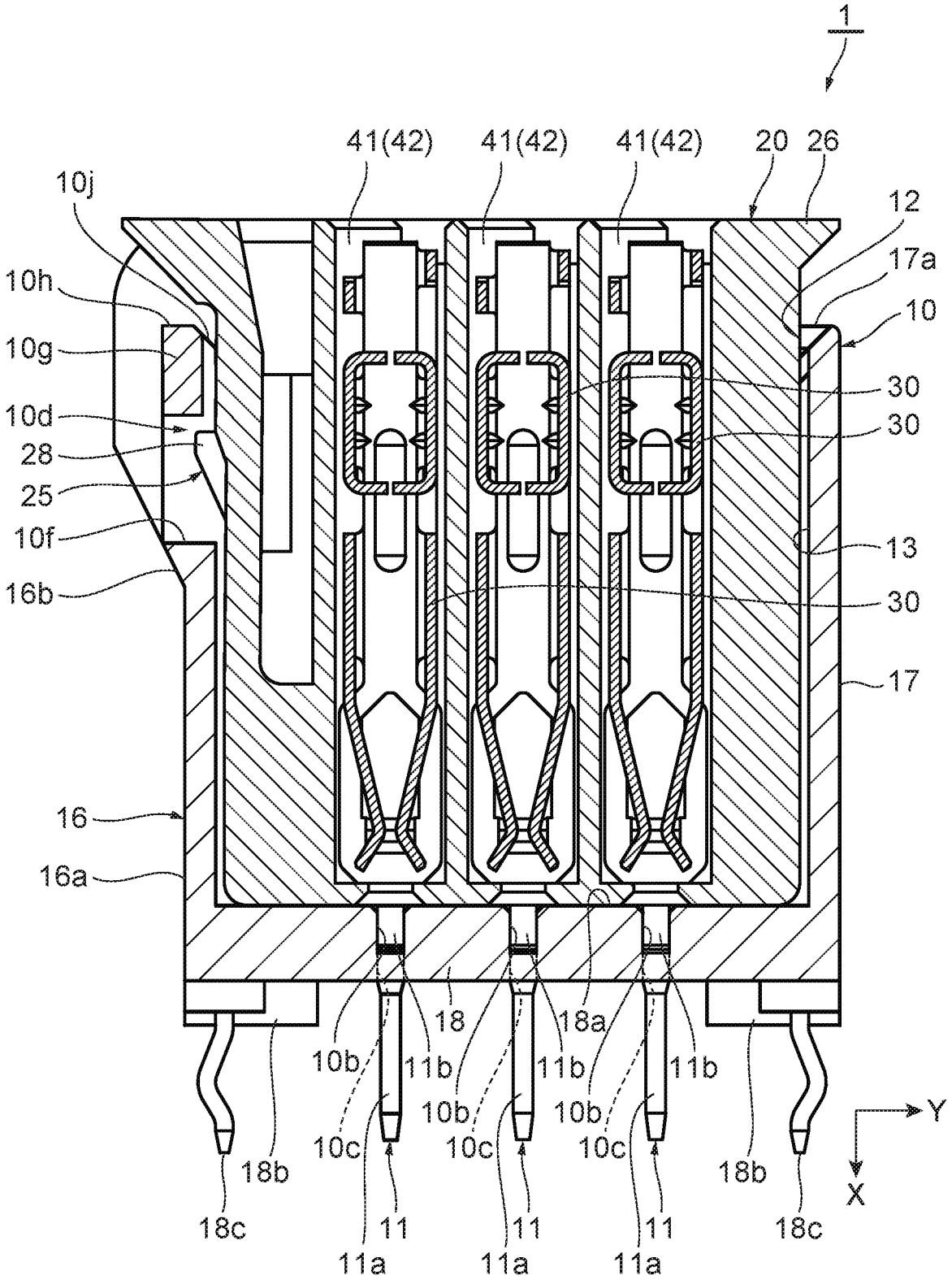
FIG. 4 is a longitudinal cross-sectional view of the stacked type wafer connector and fitting connector of FIG. 2.

FIG. 2 is a perspective view of the connector assembly 1. FIG. 3 is a perspective view of the connector assembly 1 viewed from a direction different from that of FIG. 2. FIG. 4 is a cross-sectional view of the connector assembly 1 obtained by cutting the connector assembly 1 along a plane (XY plane) extending in both the X-axis and the Y-axis. As illustrated in FIGS. 2 to 4, a plurality of wafer connectors 20 are disposed along the Z-axis inside the fitting connector 10, and each wafer connector 20 includes a plurality of terminals 30 and an electrically insulating wafer 40 including a cavity 41 in which the terminals 30 are accommodated. The cavity 41 is divided into a plurality of channels 42.

For example, a plurality of contacts 11 to be inserted into the board B extend from the fitting connector 10, and each contact 11 has a rod shape extending along the X-axis direction. The fitting connector 10 includes a concave portion 10*b* which is recessed downward (toward the board B) in the bottom surface 18*a* of the bottom portion 18 of the fitting connector 10 and into which the extension portion 11*b* of the insertion portion 11*a* enters, and a hole portion 10*c* through which the insertion portion 11*a* of the contact 11 penetrates along the X-axis. The contact 11 is fixed to the fitting connector 10 in a state in which the insertion portion 11*a* is inserted into the hole portion 10*c* and the extension portion 11*b* enters the concave portion 10*b*. The fitting connector 10 includes an open end 12 and a receiving region 13 for receiving the wafer connector 20. The fitting connector 10 defines a receiving region 13 for receiving a plurality of wafer connectors 20. For example, the receiving region 13 is a region inside the box-shaped fitting connector 10, and the open end 12 is a portion that opens on the opposite side of the bottom portion 18 (board B). In the receiving region 13, for example, a plurality of wafer connectors 20 are fitted to the fitting connector 10 along the X-axis, and terminals 30 within the wafer connectors 20 are connected to (in contact with) contacts 11 extending from the fitting connector 10.

For example, four wafer connectors 20 are fitted to the fitting connector 10. Each of the plurality of wafer connectors 20 includes a latch engaging portion 25 that engages with the fitting connector 10. The fitting connector 10 includes an engaged portion 10*d* with which the latch engaging portion 25 is engaged. The wafer connector 20 is fitted to the fitting connector 10 by engaging the latch engaging portion 25 with the engaged portion 10*d*.

The engaged portion 10*d* of the fitting connector 10 includes, for example, a hole portion 10*f* with which the latch engaging portion 25 is engaged and which penetrates the engaged portion 10*d* in the Y-axis direction. For example, all of the plurality of wafer connectors 20 arranged in the Z-axis direction are engaged with the engaged portion 10*d*. However, among the plurality of wafer connectors 20 arranged in the Z-axis direction, the engagement mode of the latch engaging portions 25 of some of the wafer connectors 20 may be different from the engagement mode of the latch engaging portions 25 of the remaining wafer connectors 20.

Figure 5:
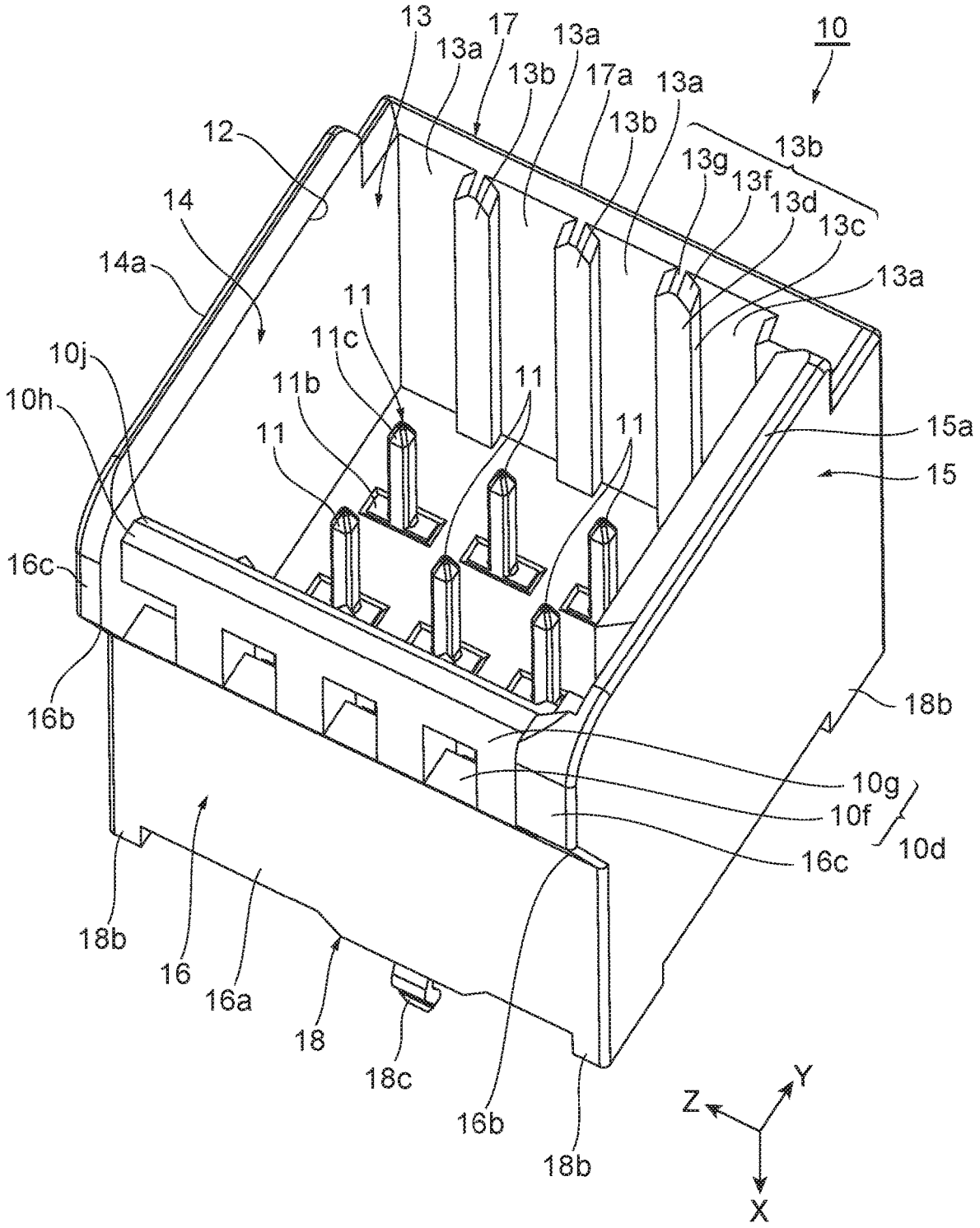
FIG. 5 is a perspective view illustrating a fitting connector according to an embodiment.

FIG. 5 is a perspective view of the fitting connector 10. As illustrated in FIG. 5, the contact 11 includes the above-described extension portion 11*b* and a rod-shaped terminal connecting portion 11*c* extending from the extension portion 11*b* to the opposite side of the insertion portion 11*a* and entering the terminal 30. In addition, the fitting connector 10 includes a first side wall 14 and a second side wall 15, arranged along the Z-axis direction, and a third side wall 16 and a fourth side wall 17, arranged along the Y-axis direction. The receiving region 13 is defined by the bottom portion 18, the first side wall 14, the second side wall 15, the third side wall 16, and the fourth side wall 17 of the above-described fitting connector 10, and an open end 12 is provided on the opposite side of the bottom portion 18.

The receiving region 13 is partitioned for each wafer connector 20 to be fitted to the fitting connector 10, for example. The fitting connector 10 includes a plurality of receiving cavities 13*a* for receiving the wafer connectors 20, and the plurality of receiving cavities 13*a* are partitioned from each other by interposing protrusions 13*b*. That is, the receiving cavity 13*a* is defined on each of one side and the other side of the protrusions 13*b* in the Z-axis direction. The protrusion 13*b* is formed by, for example, a protruding surface 13*c* protruding from the inner surface of the fourth side wall 17, a linear top surface 13*d* extending in the X-axis direction at the protruding end of the protruding surface 13*c*, a tapered surface 13*f* inclined in a direction in which the width of the top surface 13*d* decreases at the end of the protruding surface 13*c* on the open end 12 side, and a top face 13*g* located on the open end 12 side of the tapered surface 13*f*.

The bottom portion 18 includes, for example, a plurality of convex portions 18*b* protruding to the outside (lower side, board B side) of the bottom portion 18 in the X-axis direction, and a board insertion portion 18*c* inserted into the board B. For example, the board insertion portion 18*c* is a metallic portion different from a resin portion (e.g., portions other than the board insertion portion 18*c*) of the fitting connector 10. The bottom portion 18 has, for example, a rectangular shape, and a convex portion 18*b* is provided at each of four corners of the bottom portion 18. For example, each of the plurality of convex portions 18*b* is in contact with the upper surface of the board B, and a gap S1 (see FIG. 1) is formed between a portion of the bottom portion 18 other than the convex portions 18*b* and the upper surface of the board B. The bottom portion 18 includes, for example, a pair of board insertion portions 18*c* arranged along the Y-axis direction, and the fitting connector 10 is fixed to the board B by inserting each of the board insertion portions 18*c* into the board B.

The third side wall 16 includes an outer surface 16*a* extending along both the X-axis direction and the Z-axis direction, an inclined surface 16*b* inclined outward in the Y-axis direction from an end of the outer surface 16*a* opposite to the bottom portion 18, and an outer surface 16*c* extending in both the X-axis direction and the Z-axis direction at an end of the 16*b* opposite to the outer surface 16*a*. The outer surface 16*a*, the inclined surface 16*b*, and the outer surface 16*c* are, for example, all flat.

The above-described engaged portion 10*d* is formed on the inclined surface 16*b* and the outer surface 16*c*. The engaged portion 10*d* is formed, for example, at a position recessed toward the center of the fitting connector 10 from the inclined surface 16*b* and the outer surface 16*c*. As an example, the outer surface 16*c* and the inclined surface 16*b* are formed on both left and right sides of the engaged portion 10*d*, and the inclined surface 16*b* is formed on the lower side of the engaged portion 10*d*. The engaged portion 10*d* includes, for example, a wall portion 10*g* extending along the X-axis direction and the Z-axis direction, and a plurality of hole portions 10*f* penetrating the wall portion 10*g* in the Y-axis direction.

As an example, the wall portion 10*g* includes a top face 10*h* facing upward and an inclined surface 10*j* inclined obliquely from the top face 10*h* toward the inner side and the lower side of the fitting connector 10. A top face 10*h* of the engaged portion 10*d* is recessed from upper ends 14*a* and 15*a* of the first side wall 14 and the second side wall 15, respectively, and at least a portion of the plurality of latch engaging portions 25 is exposed to the recessed portion. In this manner, the top face 10*h* of the engaged portion 10*d* is recessed from the upper ends 14*a* and 15*a* of the first side wall 14 and the second side wall 15, respectively, and at least a portion of the latch engaging portion 25 is exposed to the recessed portion, so that each latch engaging portion 25 can be easily pinched by a finger or the like.

The first side wall 14, the second side wall 15, and the fourth side wall 17 are, for example, all flat plates. The height of the upper end 17*a* of the fourth side wall 17 is lower than the height of the upper end 14*a* of the first side wall 14 and the height of the upper end 15*a* of the second side wall 15. The height of the upper end 17*a* of the fourth side wall 17 may be substantially the same as the height of the top face 10*h* of the engaged portion 10*d* of the third side wall 16. A protruding portion 26, which will be described later, of the wafer connector 20 protrudes from an upper end 17*a* of the fourth side wall 17.

Figure 6:
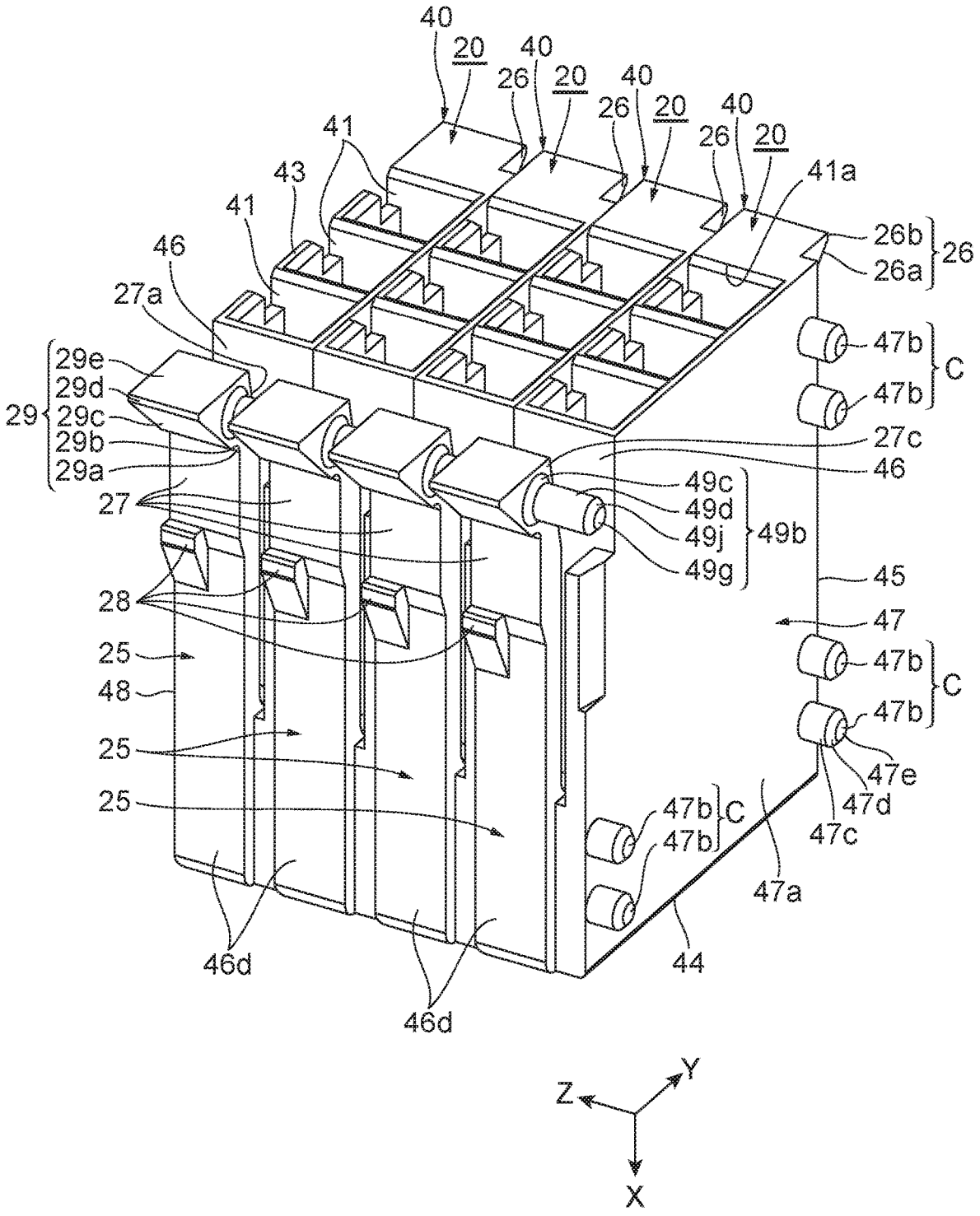
FIG. 6 is a perspective view illustrating a state in which a plurality of wafer connectors according to an embodiment are stacked.
Figure 7:
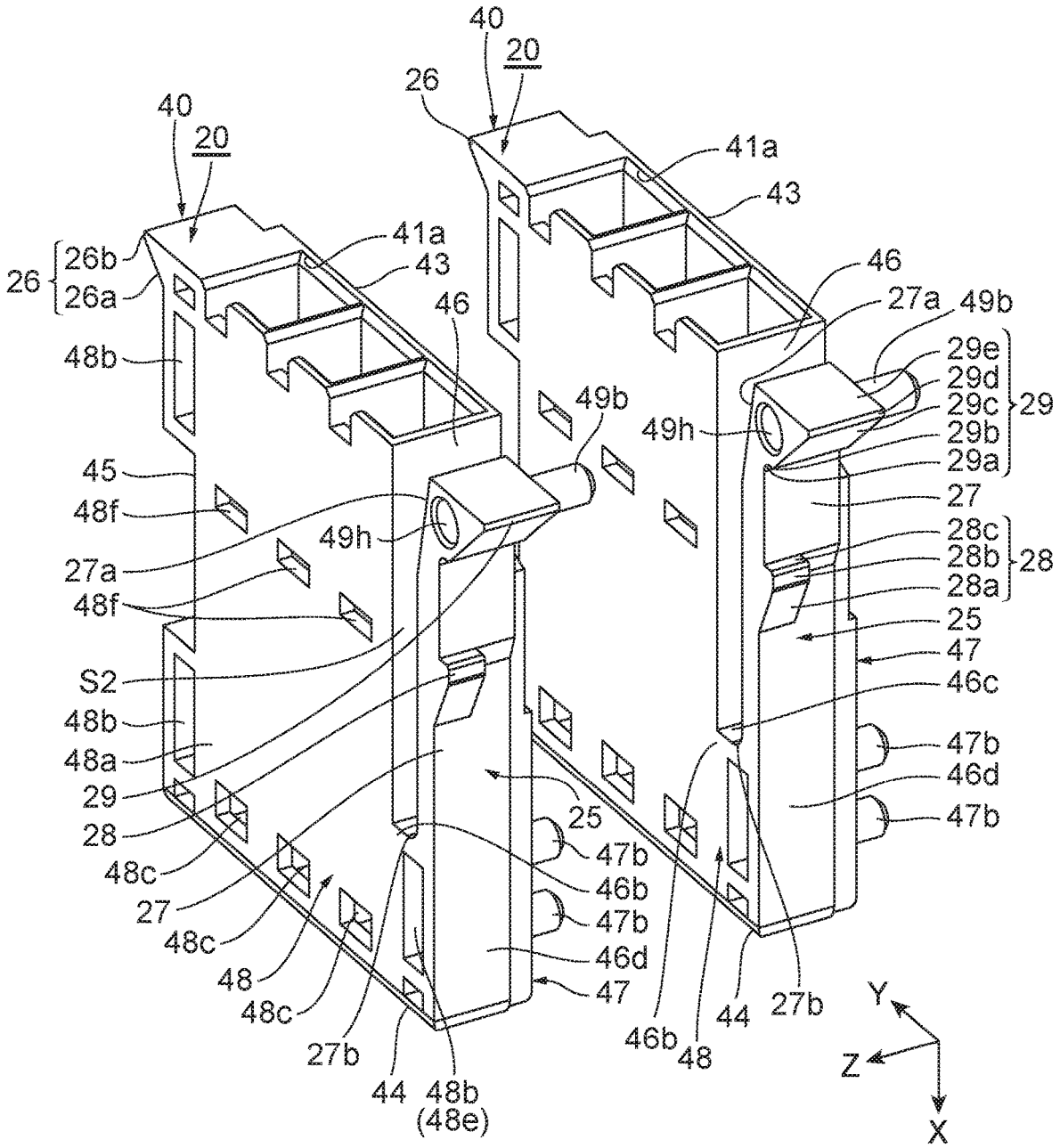
FIG. 7 is a perspective view of a first wafer connector and a second wafer connector among the plurality of wafer connectors of FIG. 6.
Figure 8:
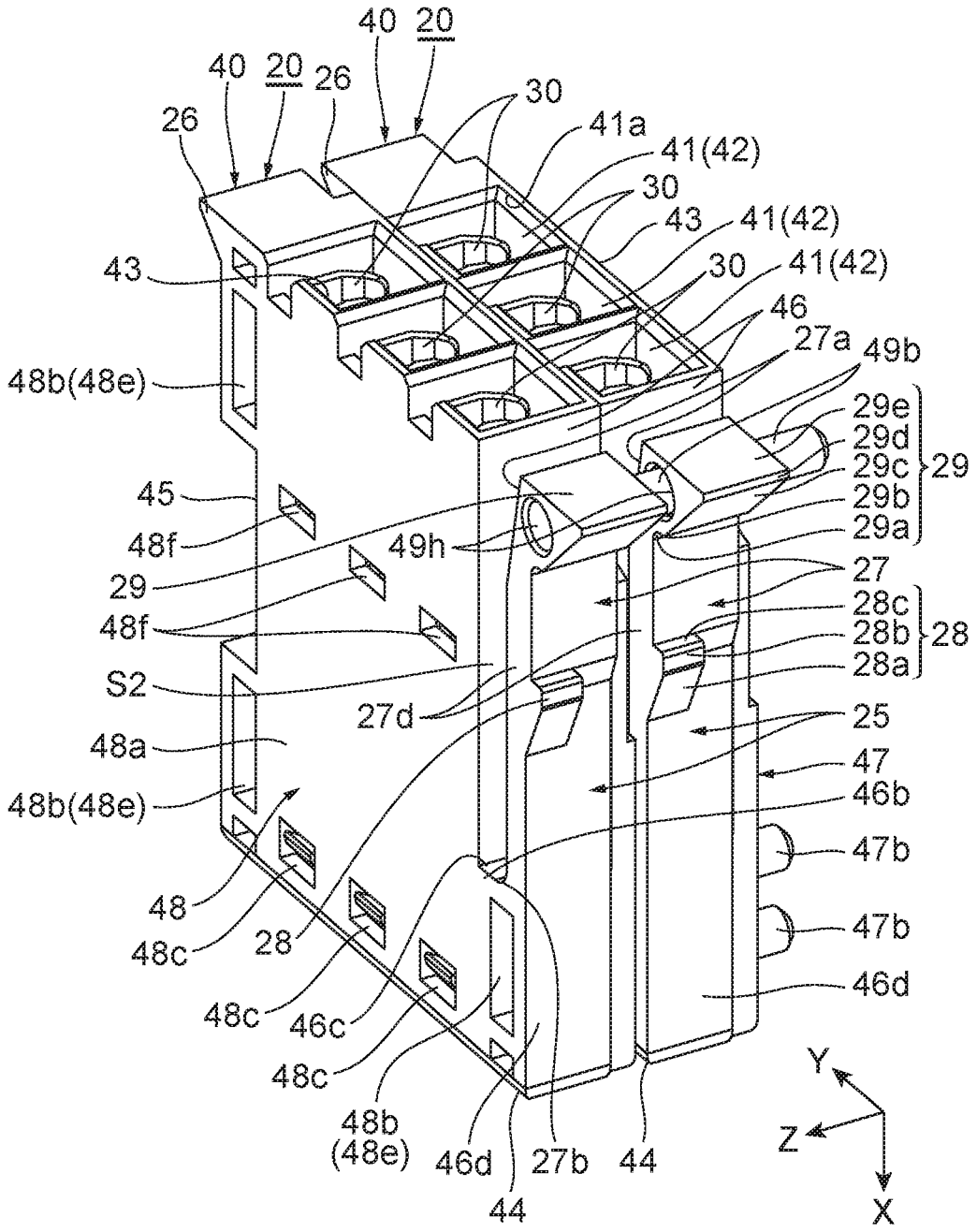
FIG. 8 is a perspective view illustrating a state in which the first wafer connector and the second wafer connector of FIG. 7 are stacked.

FIG. 6 is a perspective view illustrating a plurality of stacked wafer connectors 20. FIG. 7 is a perspective view illustrating a state in which the two wafer connectors 20 are separated from each other. FIG. 8 is a perspective view illustrating a state in which two wafer connectors 20 are engaged with each other. As illustrated in FIGS. 6, 7, and 8, for example, a plurality of plate-shaped wafer connectors 20 are stacked along the Z-axis direction. As described above, each wafer connector 20 includes a terminal 30 and an electrically insulating wafer 40. The wafer 40 has, for example, a plate-shape extending in the X-axis direction and the Y-axis direction and having a thickness in the Z-axis direction.

The wafer 40 of the wafer connector 20 includes a first end surface 43 and a second end surface 44, arranged along the X-axis direction, a first side surface 45 and a second side surface 46, arranged along the Y-axis direction, and a first base portion 47 and a second base portion 48, arranged along the Z-axis direction. The first end surface 43 and the second end surface 44 face each other, and the first base portion 47 and the second base portion 48 extend between the first end surface 43 and the second end surface 44. The first side surface 45 and the second side surface 46 face each other, and the first base portion 47 and the second base portion 48 extend between the first side surface 45 and the second side surface 46. The cavity 41 is defined between the first base portion 47 and the second base portion 48.

The first end surface 43 is a portion that receives an external terminal to be inserted, and has, for example, a rectangular shape that faces the X-axis direction and extends long in the Y-axis direction. That is, the first end surface 43 has a rectangular shape including a long side extending in the Y-axis direction and a short side extending in the Z-axis direction. As an example, the first end surface 43 has a planar shape. In the first end surface 43, for example, openings 41*a* of the plurality of cavities 41 arranged along the Y-axis direction are formed. As an example, each opening 41*a* has a rectangular shape.

The second end surface 44 faces, for example, the opposite side of the first end surface 43 and receives the plurality of contacts 11 extending from the fitting connector 10. The second end surface 44 has, for example, a rectangular shape that faces the X-axis direction and extends long in the Y-axis direction, similarly to the first end surface 43. The first side surface 45 is provided with a protruding portion 26 protruding in the Y-axis direction at one end on the first end surface 43 side. The first side surface 45 has, for example, a rectangular shape extending long in the X-axis direction. The protruding portion 26 includes an inclined surface 26*a* extending obliquely with respect to both the X-axis direction and the Y-axis direction, and a top surface 26*b* located between the inclined surface 26*a* and the first end surface 43 side.

For example, the second side surface 46 extends from the first end surface 43 along the X-axis direction. The second side surface 46 is provided with a protruding portion 46*b* protruding from the side opposite to the first end surface 43 (the second end surface 44 side) and a latch engaging portion 25 extending from the protruding portion 46*b* along the second side surface 46. The second side surface 46 has, for example, a rectangular shape including a long side along the X-axis direction and a short side along the Z-axis direction. The protruding portion 46*b* includes a side surface 46*c* extending from the second side surface 46 in the Y-axis direction and the Z-axis direction, and a top surface 46*d* extending in the X-axis direction and the Z-axis direction at an end of the side surface 46*c* opposite to the second side surface 46.

The latch engaging portion 25 is formed integrally with the wafer 40. The latch engaging portion 25 includes a plate-shaped flexible arm 27 continuous with the top surface 46*d*, a latch portion 28 protruding outward in the Y-axis direction from the flexible arm 27, and a pressing portion 29 protruding outward in the Y-axis direction from the distal end of the flexible arm 27 and pressed in the Y-axis direction by a finger or the like. The flexible arm 27 extends from the side surface 46*c* of the protruding portion 46*b* toward the first end surface 43, and an inclined surface 27*a* inclined with respect to both the X-axis direction and the Y-axis direction is formed on the opposite side of the pressing portion 29 at the distal end of the flexible arm 27.

For example, a curved surface 27*b* that connects the flexible arm 27 and the side surface 46*c* to each other is formed between the flexible arm 27 and the side surface 46*c*. A gap S2 is formed between the second side surface 46 and the latch engaging portion 25 (flexible arm 27). The pressing portion 29 is a portion that is pressed toward the second side surface 46. When the pressing portion 29 is pressed, the flexible arm 27 bends in the Y-axis direction with the side surface 46*c* as a starting point, and the flexible arm 27 bends in the Y-axis direction to engage and disengage the latch portion 28.

The engagement and disengagement of the latch portions 28 are performed in conjunction with each other in the plurality of integrated wafer connectors 20, for example. FIG. 6 illustrates a state of a latch engagement position where the wafer connector 20 is latch-engaged to the fitting connector 10. For example, the latch engaging portions 25 of the plurality of wafer connectors 20 move between the latch engagement position and the latch disengagement position by bending in conjunction with each other. The latch disengagement position indicates a state in which the plurality of latch engaging portions 25 are bent so that the plurality of latch engaging portions 25 are closer to the second side surface 46 than in the state illustrated in FIG. 6, for example. Details of the latch engagement position and the latch disengagement position by the latch engaging portion 25 will be described later.

The latch portion 28 is provided between the side surface 46*c* (the proximal end of the flexible arm 27) and the pressing portion 29 (the distal end of the flexible arm 27). The latch portion 28 includes a tapered surface 28*a* inclined from the flexible arm 27 in both the X-axis direction and the Y-axis direction, a top surface 28*b* extending along the X-axis direction and the Z-axis direction at an end portion of the tapered surface 28*a* on the outer side in the Y-axis direction, and a side surface 28*c* extending along the Y-axis direction and the Z-axis direction on the side of the top surface 28*b* opposite to the tapered surface 28*a*. The side surface 28*c* is a portion facing the lower surface of the wall portion 10*g* of the engaged portion 10*d*, and the top surface 28*b* and the tapered surface 28*a* are portions that are latch-engaged with the engaged portion 10*d* and exposed from the hole portion 10*f*.

The pressing portion 29 includes a curved surface 29*a* extending from the flexible arm 27, a first protruding surface 29*b* extending from the curved surface 29*a*, an inclined surface 29*c* extending from the first protruding surface 29*b*, a top surface 29*d*, and a second protruding surface 29*e* extending from the top surface 29*d* on the side opposite to the inclined surface 29*c*. The curved surface 29*a* is inclined with respect to both the X-axis direction and the Y-axis direction from the flexible arm 27. The first protruding surface 29*b* extends in the Y-axis direction and the Z-axis direction from a side of the curved surface 29*a* opposite to the flexible arm 27, and the inclined surface 29*c* is inclined with respect to both the X-axis direction and the Y-axis direction from an end of the first protruding surface 29*b* opposite to the curved surface 29*a*. The top surface 29*d* is located on the side of the inclined surface 29*c* opposite to the first protruding surface 29*b*, and the second protruding surface 29*e* extends along the Y-axis direction and the Z-axis direction on the side of the top surface 29*d* opposite to the inclined surface 29*c*. The top surface 29*d* is a portion to which a finger or the like is applied. When the top surface 29*d* is pressed by the finger or the like, the flexible arm 27 is bent toward the center of the wafer connector 20 in the Y-axis direction.

The first base portion 47 includes, for example, a surface 47*a* facing the other wafer connector 20 (wafer 40) along the Z-axis direction, and a protrusion 47*b* extending outward from the surface 47*a* in the thickness direction of the wafer 40 (along the Z-axis direction) and an engaging portion 49*b*. The surface 47*a* is, for example, flat, and the protrusion 47*b* is cylindrical. The engaging portion 49*b* has, for example, a cylindrical shape similarly to the protrusion 47*b*. As an example, the height of the engaging portion 49*b* is higher than the height of the protrusion 47*b*. However, the shapes of the protrusion 47*b* and the engaging portion 49*b* are not limited to the cylindrical shape, and may be, for example, a prism shape, an oval cylindrical shape, or the like, and can be appropriately changed.

The protrusion 47*b* and the engaging portion 49*b* of the wafer connector 20 (e.g., a first wafer connector) are, for example, portions to which another wafer connector 20 (e.g., a second wafer connector) is coupled. The first base portion 47 includes, for example, a plurality of protrusions 47*b* and an engaging portion 49*b*. The plurality of protrusions 47*b* are disposed, for example, at one end of the first base portion 47 in the Y-axis direction and at the other end of the first base portion 47 in the Y-axis direction, respectively. In this way, since the protrusions 47*b* are disposed at one end of the first base portion 47 in the Y-axis direction and at the other end of the first base portion 47 in the Y-axis direction, respectively, it is possible to firmly couple with other wafer connectors 20 at both ends in the Y-axis direction.

For example, in at least one end portion in the Y-axis direction (e.g., an end portion on the protruding portion 26 side), the plurality of protrusions 47*b* are respectively disposed at one end in the X-axis direction and at the other end in the X-axis direction. Since the protrusions 47*b* are respectively disposed at one end in the X-axis direction and the other end in the X-axis direction, it is possible to firmly couple with the other wafer connector 20 at both ends in the X-axis direction. In the present embodiment, the set C of two protrusions 47*b* is disposed at each of both end portions in the X-axis direction at the end portion on the protruding portion 26 side in the Y-axis direction (the opposite side of the latch engaging portion 25), and the set C of two protrusions 47*b* is disposed at the end portion on the latch engaging portion 25 side in the Y-axis direction and at the end portion on the second end surface 44 side. In each set C, two protrusions 47*b* are arranged side by side along the X-axis direction. Each protrusion 47*b* includes an outer peripheral surface 47*c* extending upward with respect to the surface 47*a*, a tapered surface 47*d* located at the upper end of the outer peripheral surface 47*c*, and a top surface 47*e* located at the upper end of the tapered surface 47*d*.

The engaging portion 49*b* is provided in the latch engaging portion 25. For example, the engaging portion 49*b* protrudes from the flexible arm 27 (e.g., the pressing portion 29) of the latch engaging portion 25 along the Z-axis direction. The engaging portion 49*b* is a portion for coupling the latch engaging portion 25 of the wafer connector 20 (e.g., a first wafer connector) to the latch engaging portion 25 of another wafer connector 20 (e.g., a second wafer connector). The plurality of latch engaging portions 25 can be interlocked with the latch engagement position and the latch disengagement position by the engaging portion 49*b*. The engaging portion 49*b* includes, for example, a first tapered surface 49*c* protruding from a side surface 27*c* of the flexible arm 27 facing the Z-axis direction, an outer peripheral surface 49*d* extending from the first tapered surface 49*c* in the Z-axis direction, a second tapered surface 49*f* having a reduced diameter at an end of the outer peripheral surface 49*d* on the side opposite to the first tapered surface 49*c*, and a top surface 49*g* facing the Z-axis direction on the side of the second tapered surface 49*f* opposite to the outer peripheral surface 49*d*.

The second base portion 48 includes a surface 48*a* facing another wafer connector 20 (e.g., a second wafer connector) along the Z-axis direction, an opening 48*b* recessed from the surface 48*a* in the thickness direction of the wafer 40 and into which the protrusion 47*b* is inserted, and terminal engaging portions 48*c* and 48*f* with which the terminals 30 inserted into the cavities 41 are engaged. The terminal engaging portions 48*c* and 48*f* are through-holes with which the terminals 30 are engaged. As an example, the terminal engaging portions 48*c* and 48*f* have a rectangular shape.

The opening 48*b* is a portion for coupling the wafer 40 of another wafer connector 20 to the wafer 40. The second base portion 48 includes, for example, a plurality of openings 48*b*. The plurality of openings 48*b* are respectively disposed at one end of the second base portion 48 in the Y-axis direction and at the other end of the second base portion 48 in the Y-axis direction. For example, in at least one end portion of the second base portion 48 in the Y-axis direction (e.g., an end portion on the protruding portion 26 side), the opening 48*b* is disposed at each of one end of the second base portion 48 in the X-axis direction and the other end of the second base portion 48 in the X-axis direction.

In the present embodiment, the opening 48*b* is disposed at each of both end portions in the X-axis direction and an end portion of the protruding portion 26 side in the Y-axis direction. An opening 48*b* is disposed at an end portion on the latch engaging portion 25 side in the Y-axis direction and an end portion on the second end surface 44 side. The opening 48*b* has, for example, a rectangular shape including a long side in the X-axis direction and a short side in the Y-axis direction. The opening 48*b* includes an inner side surface 48*e* with which the outer peripheral surface 47*c* of the protrusion 47*b* abuts. The inner side surfaces 48*e* are provided in a pair along the width direction (Y-axis direction) of the opening 48*b*, for example.

The width of the opening 48*b* (the distance between the pair of inner side surfaces 48*e*) is substantially the same as the diameter of the outer peripheral surface 47*c* of the protrusion 47*b*. Therefore, when the protrusion 47*b* is pushed into the opening 48*b*, the outer peripheral surface 47*c* abuts against each inner side surface 48*e* of the opening 48*b*, and the protrusion 47*b* is coupled to the opening 48*b*. For example, the two protrusions 47*b* forming the set C are inserted into the one opening 48*b*, and the outer peripheral surfaces 47*c* of the two protrusions 47*b* abut on the pair of inner side surfaces 48*e*, respectively. In this way, by including one opening 48*b* for a plurality of protrusions 47*b*, the number of openings 48*b* can be reduced.

Figure 9:
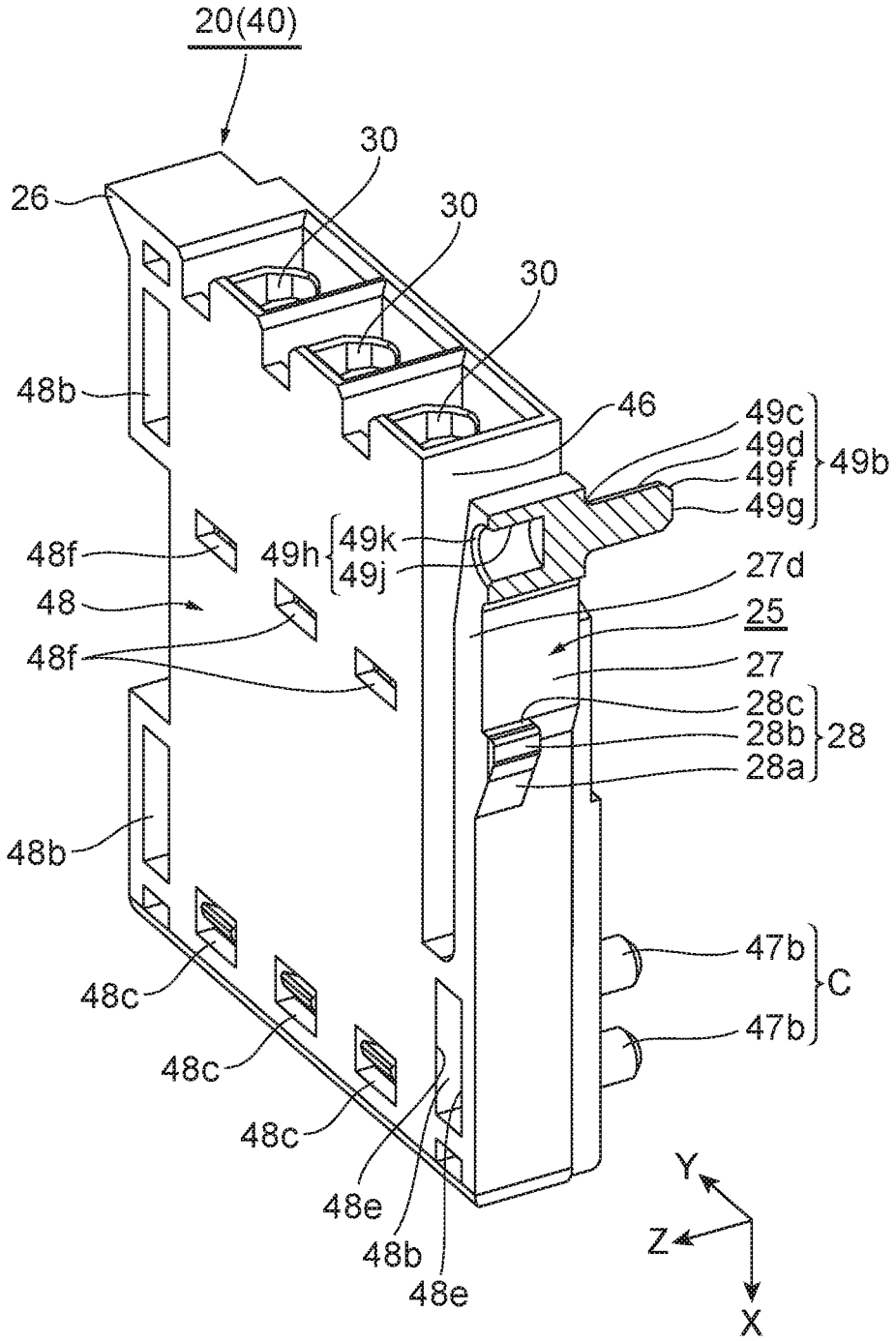
FIG. 9 is a cutaway cross-sectional perspective view of an engaging portion of the wafer connector of FIG. 6.

As illustrated in FIG. 9, the second base portion 48 includes an engaging portion 49*h* that engages with the engaging portion 49*b* of the first base portion 47. The engaging portion 49*h* is, for example, an engaged portion to be engaged with the engaging portion 49*b* formed in the first base portion 47. As an example, the engaging portion 49*h* is a hole, into which the engaging portion 49*b* of another wafer 40 is inserted, and is provided in the latch engaging portion 25. For example, the engaging portion 49*h* is formed on a side surface 27*d* facing opposite to the side surface 27*c* in the flexible arm 27 (e.g., the pressing portion 29) of the latch engaging portion 25. The engaging portion 49*h* includes, for example, an inner peripheral surface 49*j* with which the outer peripheral surface 49*d* of the engaging portion 49*b* abuts, and a tapered surface 49*k* located on the side surface 27*d* side of the inner peripheral surface 49*j*. As an example, the diameter of the inner peripheral surface 49*j* is substantially the same as the diameter of the outer peripheral surface 49*d*. In this case, the engaging portion 49*b* is firmly engaged with the engaging portion 49*h*.

Figure 10:
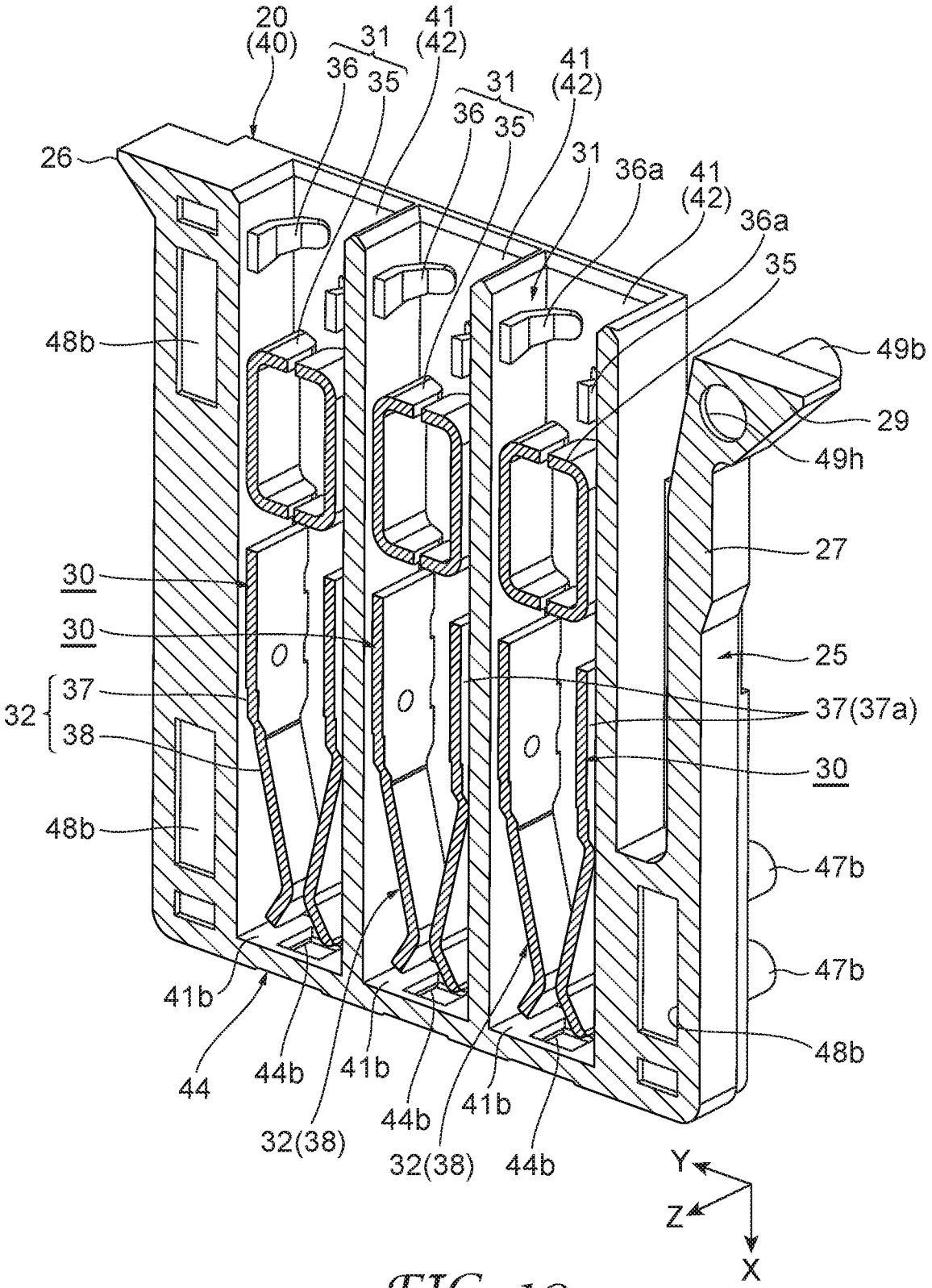
FIG. 10 is a cross-sectional perspective view illustrating internal terminals of the wafer connector of FIG. 6.

FIG. 10 is a sectional perspective view illustrating the internal structure of the wafer 40. As illustrated in FIG. 10, on the second end surface 44 of the wafer 40, for example, a plurality of hole portions 44*b* arranged in the Y-axis direction are formed, and each hole portion 44*b* penetrates in the X-axis direction in the second end surface 44 and communicates with the cavity 41. The cavity 41 includes a bottom surface 41*b* to which a fitting portion 32 of the terminal 30 faces along the X-axis direction.

A plurality of terminals 30 arranged apart from each other are accommodated in the cavity 41. Each terminal 30 includes a wire connection portion 31 disposed at a position adjacent to the first end surface 43 and a fitting portion 32 disposed at a position adjacent to the second end surface 44. The wire connection portion 31 includes a pressure contact portion 35 and a first support portion 36, and the fitting portion 32 includes a second support portion 37 and a contact arm portion 38.

The fitting portion 32 includes, for example, contact arm portions 38 which are facing each other and have flexibility, and when the fitting portion 32 receives the contacts 11 of the fitting connector 10, the contacts 11 are received between the pair of contact arm portions 38 which are spread. The second support portion 37 is provided on the wire connection portion 31 side of the contact arm portion 38. For example, the second support portion 37 includes a pair of arm portions 37*a* facing each other.

The first support portion 36 includes, for example, a pair of arm portions 36*a* that receive a wire inserted into the cavity 41 and extending along the X-axis direction. For example, the positions of the pair of arm portions 36*a* in the X-axis direction are shifted from each other. That is, one of the pair of arm portions 36*a* is positioned closer to the end-side in the X-axis direction than the other. The pressure contact portion 35 is a portion that electrically connects the wire inserted into the cavity 41 to the terminal 30. For example, in a state where the pressure contact portion 35 supports a wire inserted into the cavity 41 from the outside of the wafer 40, the pressure contact portion 35 electrically connects the wire to the terminal 30.

Next, a fitting structure of the wafer connector 20 with respect to the fitting connector 10 will be described. As illustrated in FIG. 2, the respective latch engaging portions 25 of the plurality of wafer connectors 20 arranged in the Z-axis direction are engaged with the engaged portions 10*d* of the fitting connector 10. For example, among the plurality of wafer connectors 20 arranged in the Z-axis direction, the latch engaging portion 25 of the wafer connector 20 located on the center-side in the Z-axis direction may be deeply engaged with the fitting connector 10, and the latch engaging portion 25 of the wafer connector 20 located on the end-side in the Z-axis direction may be shallowly engaged with the fitting connector 10. As an example, among the four wafer connectors 20 arranged in the Z-axis direction, the latch engaging portions 25 of the two wafer connectors 20 located on the center-side in the Z-axis direction may be deeply engaged with the fitting connector 10, and the latch engaging portions 25 of the two wafer connectors 20 located on the end-side in the Z-axis direction may be shallowly engaged with the fitting connector 10.

Figure 11:
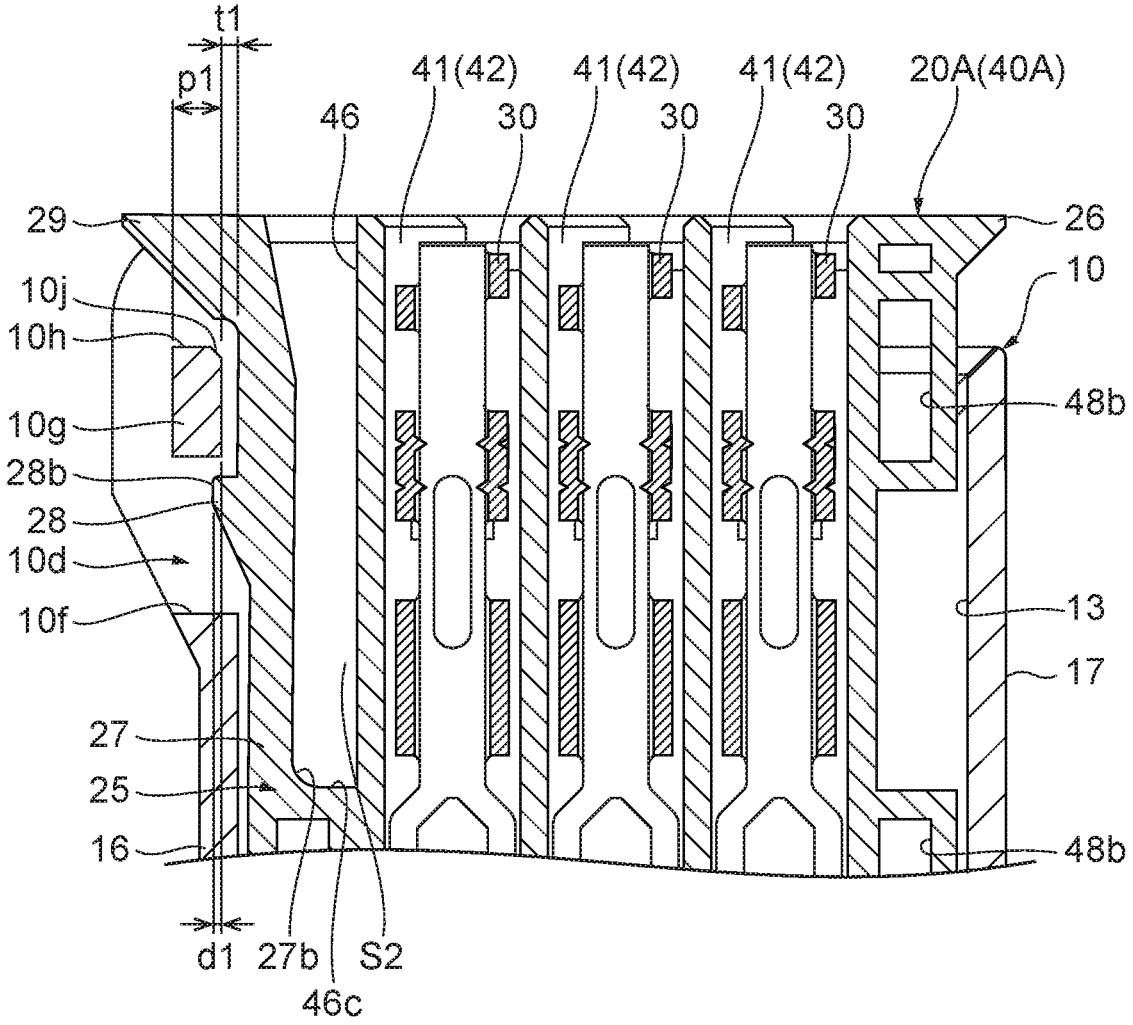
FIG. 11 is a cross-sectional view illustrating a latch portion of the wafer connector received in a receiving cavity on the end-side of the fitting connector and the engaged portion of the receiving cavity according to an embodiment.
Figure 12:
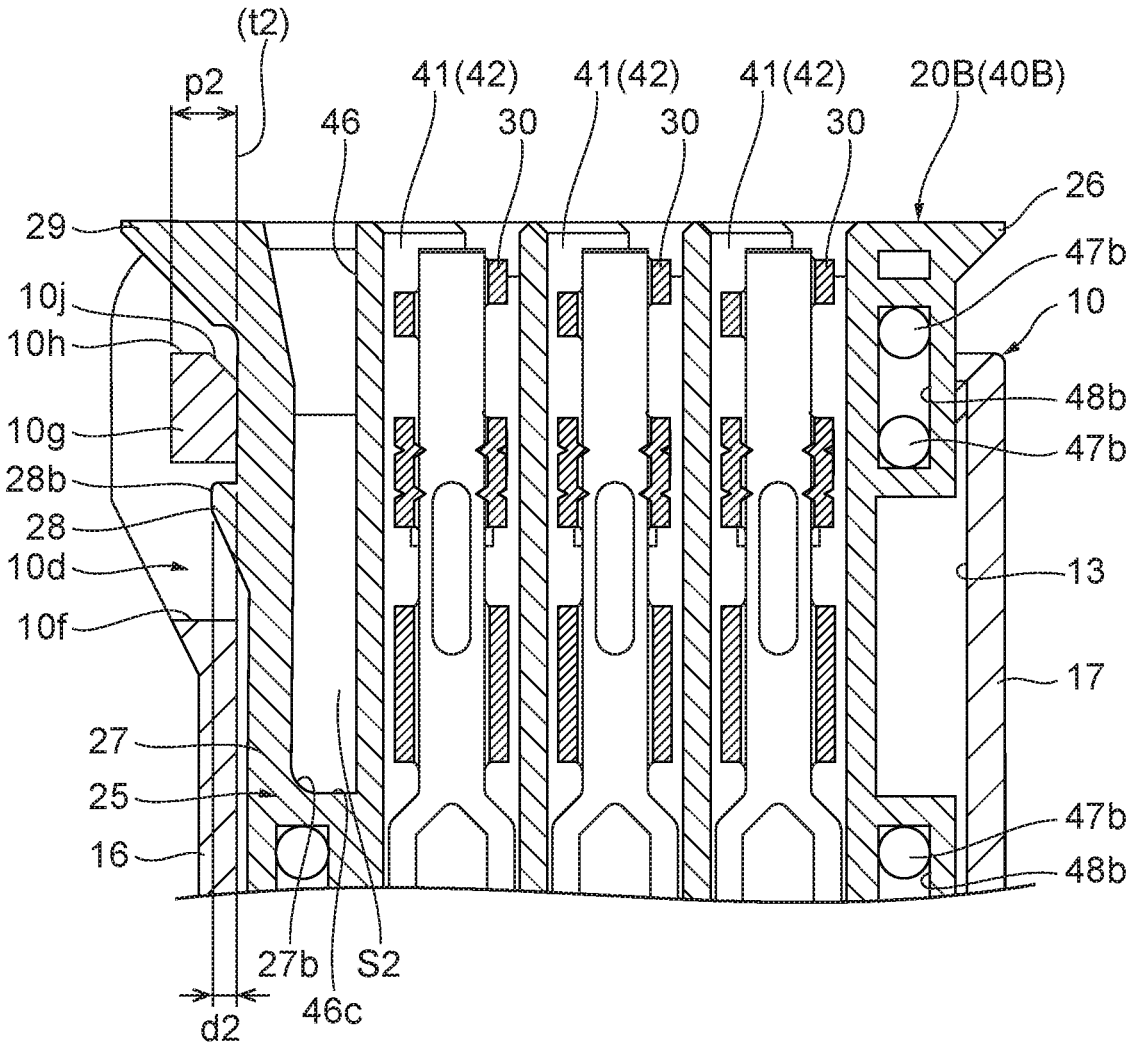
FIG. 12 is a cross-sectional view illustrating the latch portion of the wafer connector received in the receiving cavity on the center-side of the fitting connector and the engaged portion of the receiving cavity according to an embodiment.

FIG. 11 is a cross-sectional view illustrating an example of a latch engagement position in which the first latch engaging portion 25 of the first wafer connector 20A (wafer 40A) located on the end-side in the Z-axis direction is engaged with the fitting connector 10. FIG. 12 is a cross-sectional view illustrating an example of a latch engagement position in which the second latch engaging portion 25 of the second wafer connector 20B (wafer 40B) positioned on the center-side in the Z-axis direction is engaged with the fitting connector 10. The configurations of the first wafer connector 20A and the second wafer connector 20B (wafer 40A and wafer 40B) are, for example, the same as the configurations of the wafer connector 20 and the wafer 40 described above.

The latch engaging portion 25 of each of the first wafer connector 20A and the second wafer connector 20B includes a flexible arm 27. The first flexible arm 27 of the first wafer connector 20A moves between a latch engagement position where the first wafer connector 20A is latch-engaged to the fitting connector 10 and a latch disengagement position where the first wafer connector 20A is unlatched from the fitting connector 10. The second flexible arm 27 of the second wafer connector 20B moves between a latch engagement position where the second wafer connector 20B is latch-engaged to the fitting connector 10 and a latch disengagement position where the second wafer connector 20B is unlatched from the fitting connector 10. As described above, the first wafer connector 20A and the second wafer connector 20B are connected to each other by the engaging portion 49*b* and the engaging portion 49*h*. For example, when the first flexible arm 27 moves between the latch engagement position and the latch disengagement position in a state in which the first engaging portion 49*b* of the first wafer connector 20A is engaged with the second engaging portion 49*h* of the second wafer connector 20B, the second flexible arm 27 also moves between the latch engagement position and the latch disengagement position in conjunction with the first flexible arm 27.

For example, FIGS. 11 and 12 illustrate the latch-engaged state of each of the first wafer connector 20A and the second wafer connector 20B, and transition from the latch-engaged state to the unlatched state occurs when the flexible arm 27 is moved toward the center of the fitting connector 10 by the disengagement distances d1 and d2. For example, the disengagement distance d1 of the first wafer connector 20A is a distance between the outer surface (e.g., the top surface 28*b*) of the latch portion 28 of the first wafer connector 20A and the inner surface (e.g., the inner surface of the wall portion 10*g*) of the engaged portion 10*d*.

The position of the flexible arm 27 when the flexible arm 27 is bent toward the center-side of the fitting connector 10 by the disengagement distance d1 is the latch disengagement position. Similarly to the disengagement distance d1, the disengagement distance d2 of the second wafer connector 20B is a distance between the outer surface of the latch portion 28 of the second wafer connector 20B and the inner surface of the engaged portion 10*d*. The position of the flexible arm 27 when the flexible arm 27 is bent toward the center-side of the fitting connector 10 by the disengagement distance d2 is the latch disengagement position.

When the first wafer connector 20A is pulled up from the fitting connector 10 in a state where the first wafer connector 20A is at the latch disengagement position, the first wafer connector 20A can be pulled out from the fitting connector 10. As described above, the flexible arm 27 of the second wafer connector 20B is connected to the flexible arm 27 of the first wafer connector 20A by interposing the engaging portion 49*b* and the engaging portion 49*h*.

Thus, when the first wafer connector 20A is in the latch-engaged state, the second wafer connector 20B is also in the latch-engaged state, and when the first wafer connector 20A is in the unlatched state, the second wafer connector 20B is also in the unlatched state. Therefore, since the second wafer connector 20B is also pulled up when the first wafer connector 20A is pulled up from the fitting connector 10, the second wafer connector 20B can be pulled out simultaneously with the pulling-out of the first wafer connector 20A. Therefore, all the wafer connectors 20 can be pulled out only by setting one wafer connector 20 to the unlatched state.

As described above, the disengagement distance d1 of the first wafer connector 20A is different from the disengagement distance d2 of the second wafer connector 20B, for example, the disengagement distance d1 is smaller than the disengagement distance d2. In the present disclosure, the "disengagement distance" indicates a distance by which the latch engaging portion 25 (flexible arm 27) moves when transitioning from the latch-engaged state to the unlatched state, and may include an engagement amount by the latch engaging portion 25. In the present embodiment, for example, the engagement amount is different for each wafer connector 20. An example of realizing this configuration will be described. As described above, the fitting connector 10 defines the plurality of receiving cavities 13*a* (see FIG. 5) that receive the first wafer connector 20A and the second wafer connector 20B, respectively, and includes the engaged portions 10*d* that engage with the latch portions 28 of the first wafer connector 20A and the second wafer connector 20B received in the respective receiving cavities 13*a*.

The width p1 of the engaged portion 10*d* of the first receiving cavity 13*a* that receives the first wafer connector 20A may be different from the width p2 of the engaged portion 10*d* of the second receiving cavity 13*a* that receives the second wafer connector 20B. For example, the width p1 of the wall portion 10*g* constituting the engaged portion 10*d* of the first receiving cavity 13*a* may be narrower than the width p2 of the wall portion 10*g* constituting the engaged portion 10*d* of the second receiving cavity 13*a*. Since the width p1 is smaller than the width p2, a configuration in which the disengagement distance d1 is shorter than the disengagement distance d2 is realized. The first receiving cavity 13*a* indicates the receiving cavity 13*a* located on the end-side of the fitting connector 10 in the Z-axis direction, and the second receiving cavity 13*a* indicates the receiving cavity 13*a* located on the center-side of the fitting connector 10 in the Z-axis direction.

The interval t1 between the engaged portion 10*d* of the first receiving cavity 13*a* and the flexible arm 27 when the first wafer connector 20A is received in the first receiving cavity 13*a* may be different from the interval t2 between the engaged portion 10*d* of the second receiving cavity 13*a* and the flexible arm 27 when the second wafer connector 20B is received in the second receiving cavity 13*a*. For example, the interval t1 may be wider than the interval t2. Since the interval t1 is wider than the interval t2, a configuration in which the disengagement distance d1 is shorter than the disengagement distance d2 is realized. The interval t2 may be 0. In this case, the flexible arm 27 of the second wafer connector 20B and the engaged portion 10*d* are in contact with each other.

Next, effects of the wafer connector 20 and the fitting connector 10 according to the present embodiment will be described. For example, as illustrated in FIGS. 7 and 8, in the wafer connector 20 according to the present embodiment, when the first flexible arm 27 moves between the latch engagement position and the latch disengagement position in a state where the first engaging portion 49*b* of the first wafer connector 20 is engaged with the second engaging portion 49*h* of the second wafer connector 20, the second flexible arm 27 also moves between the latch engagement position and the latch disengagement position. Accordingly, since the plurality of flexible arms 27 can be interlocked with each other between the plurality of wafer connectors 20, all the wafer connectors 20 can be caused to transition to the unlatched state by only pressing the flexible arm 27 of one wafer connector 20. Therefore, the plurality of wafer connectors 20 can be easily pulled out together from the fitting connector 10. Further, since the plurality of wafer connectors 20 can be integrated by engaging the first engaging portion 49*b* of the first wafer connector 20 with the second engaging portion 49*h* of the second wafer connector 20, the plurality of integrated wafer connectors 20 can be easily inserted into the fitting connector 10. Therefore, the plurality of wafer connectors 20 can be easily inserted into and removed from the fitting connector 10.

The first engaging portion 49*b* may be a convex portion and the second engaging portion 49*h* may be a concave portion. The first engaging portion may be a concave portion and the second engaging portion may be a convex portion. In this case, the configurations of the first engaging portion and the second engaging portion can be simplified.

The wafer 40 may include at least one protrusion 47*b* extending outwardly from the wafer 40. When the second wafer connector 20 is stacked on the second wafer connector 20, the at least one protrusion 47*b* may be inserted into the at least one opening 48*b* of the second wafer connector 20. By inserting at least one protrusion 47*b* into at least one opening 48*b*, relative rotation between the first wafer connector 20 and the second wafer connector 20 may be suppressed. In this case, by inserting the protrusion 47*b* into the opening 48*b*, it is possible to prevent the wafer connector 20 from sliding in the fitting direction (X-axis direction). Further, the engagement between the plurality of wafer connectors 20 can be strengthened.

The stacked first wafer connector 20 and second wafer connector 20 may be fitted to the fitting connector 10, and the first wafer connector 20 and the second wafer connector 20 may be latch-engaged to the fitting connector 10. When one of the stacked first wafer connector 20 and second wafer connector 20 is unlatched from the fitting connector 10, the other of the stacked first wafer connector 20 and second wafer connector 20 may also be unlatched from the fitting connector 10. In this case, since the latch-engaging of the plurality of wafer connectors 20 with the fitting connector 10 and the unlatching of the plurality of wafer connectors 20 from the fitting connector 10 are performed in conjunction with each other between the plurality of wafer connectors 20, the insertion and removal can be performed more easily.

The wafer 40 may include a first base portion 47 and a second base portion 48, which extend between the first side surface 45 and the second side surface 46 facing each other and which extend between the first end surface 43 and the second end surface 44 facing each other. The latch engaging portion 25 may extend from the second side surface 46. The cavity 41 may be defined between the first base portion 47, the second base portion 48, the first side surface 45, the second side surface 46, the first end surface 43, and the second end surface 44. The wafer 40 may receive an external terminal inserted into at least one opening 41*a* defined in the first end surface 43. The second end surface 44 defines at least one hole 44*b* to be fitted to the fitting connector 10, and may receive the contacts 11 of the fitting connector 10 through the hole portions 44*b*.

As illustrated in FIGS. 5, 11, and 12, the fitting connector 10 according to the present embodiment defines a plurality of receiving cavities 13*a* for receiving a plurality of wafer connectors 20, and includes engaged portions 10*d* to be engaged with the latch portions 28 of the wafer connectors 20 received in the respective receiving cavities 13*a*. Then, the wafer connector 20 is unlatched from the fitting connector 10 by moving the latch portion 28 by the disengagement distances d1 and d2.

For at least two wafer connectors 20 received in each of the first receiving cavity 13*a* and the second receiving cavity 13*a* among the plurality of receiving cavities 13*a*, a first disengagement distance d1 when the latch portion 28 of the first wafer connector 20A moves in the first receiving cavity 13*a* may be different from a second disengagement distance d2 when the latch portion 28 of the second wafer connector 20B moves in the second receiving cavity 13*a*. As described above, even when the first disengagement distance d1 and the second disengagement distance d2 are different from each other among the plurality of wafer connectors 20, the plurality of latch portions 28 are engaged and disengaged in conjunction with each other. Therefore, it is possible to easily perform insertion and removal with respect to the fitting connector 10.

The shape of the engaged portion 10*d* of the first receiving cavity 13*a* may be different from the shape of the engaged portion 10*d* of the second receiving cavity 13*a*, so that the first disengagement distance d1 is different from the second disengagement distance d2. The expression "the shape of the engaged portion is different" is not limited to the case described above where the width p1 and the width p2 are different from each other, and also includes, for example, a case where the engaged portion is partially tapered or the degree of the taper is different, or the like. The wafer connector 20 may also be provided with a flexible arm 27 including a latch portion 28, and t2 may be different from t1, where t1 is the interval between the engaged portion 10*d* of the first receiving cavity 13*a* and the flexible arm 27 when the first wafer connector 20A is received in the first receiving cavity 13*a*, and t2 is the interval between the engaged portion 10*d* of the second receiving cavity 13*a* and the flexible arm 27 when the second wafer connector 20B is received in the second receiving cavity 13*a*. Further, the value of t2 may be 0.

The fitting connector 10 includes a plurality of contacts 11 that abut the terminals 30 of the wafer connector 20, and the plurality of contacts 11 may be disposed in the plurality of receiving cavities 13*a*. In addition, the above-described first receiving cavity 13*a* may be a receiving cavity 13*a*, on the end-side, disposed adjacent to the first side wall 14 of the fitting connector 10, and the second receiving cavity 13*a* may be a receiving cavity 13*a*, on the center-side, spaced apart from the first side wall 14 and the second side wall 15 facing the first side wall 14.

In addition, the receiving cavity 13*a* may include end-side receiving cavities 13*a* adjacent to the side walls (e.g., the first side wall 14 and the second side wall 15) facing each other and a center-side receiving cavity 13*a* disposed between the pair of end-side receiving cavities 13*a*. Each receiving cavity 13*a* may include an engaged portion 10*d* that receives the wafer connector 20 and engages with the latch portion 28 of the wafer connector 20. Further, the engaged portion 10*d* may extend along the side walls facing each other, and the relationship between the width p1 of the engaged portion 10*d* (wall portion 10*g*) on each end-side and the width p2 of the engaged portion 10*d* on each center-side may satisfy p1<p2. In this case, the latch engagement of the latch portion 28 with the engaged portion 10*d* on the end-side can be made shallower than the latch engagement of the latch portion 28 with the engaged portion 10*d* on the center-side. In addition, since the engagement amount of the latch engaging portion 25 on the center-side is larger than the engagement amount of the latch engaging portion 25 on the end-side, when the latch engaging portion 25 on the center-side having a large engagement amount is operated, the latch engaging portion 25 on the end-side having a small engagement amount can be easily disengaged. Further, the latch engaging portion 25 can be easily disengaged by pressing the pressing portion 29. Therefore, all the wafer connectors 20 can be pulled out more easily by pressing the pressing portion 29 of the latch engaging portion 25 on the center-side.

The embodiments of the wafer connector and the fitting connector according to the present disclosure have been described above. However, the shape, the size, the number, the material, the arrangement, the engagement, or the like of each portion of the wafer connector and the fitting connector according to the present disclosure are not limited to the above-described embodiments, and can be appropriately changed. For example, the shape, the size, the number, the material, and the arrangement of each of the fitting connector 10, the wafer connector 20, the terminal 30, and the wafer 40 are not limited to those in the above-described embodiment and can be appropriately changed.

Figure 13:
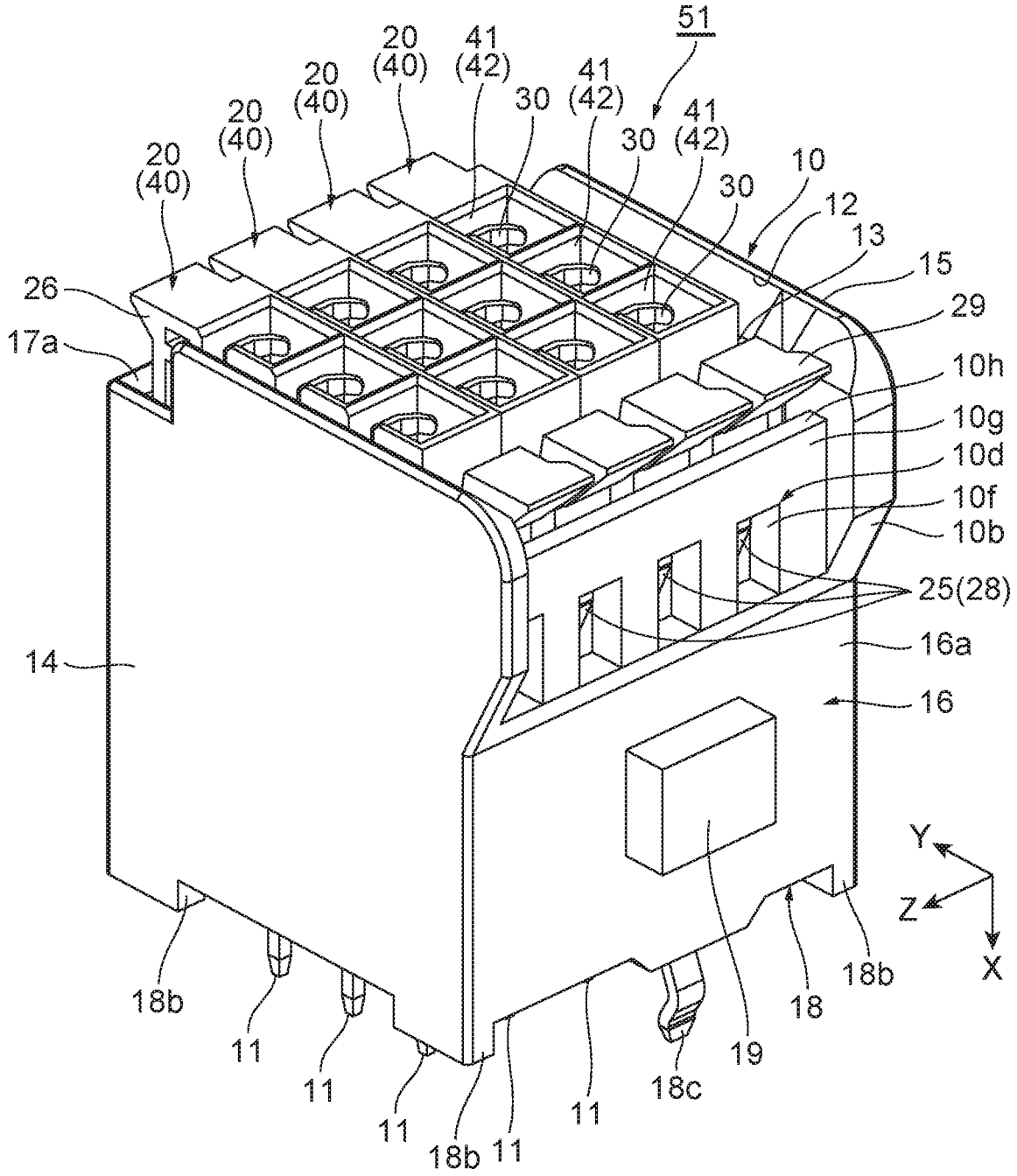
FIG. 13 is a perspective view illustrating a fitting connector and a stacked type wafer connector according to a modified example.

For example, as illustrated in FIG. 13, the fitting connector 10 of a connector assembly 51 according to a modified example may include a convex portion 19 protruding from the third side wall 16. In this case, for example, a convex portion 19 protruding outward (outward in the Y-axis direction) of the fitting connector 10 is formed on the outer surface 16*a* of the third side wall 16. As an example, the convex portion 19 protrudes in a rectangular shape in a region including the center of the outer surface 16*a*. The convex portion 19 may be provided below the engaged portion 10*d* (latch engaging portion 25) of the fitting connector 10.

In this way, by providing the convex portion 19, the convex portion 19 can function as a mark when the fitting position of the wafer connector 20 to be fitted to the fitting connector 10 is searched with a finger. That is, in the case of including the convex portion 19 positioned below the latch engaging portion 25, the target wafer connector 20 can be easily found by groping the convex portion 19. Further, the position of the connector assembly 1 on the board B can be easily recognized by groping the convex portion 19, and the target wafer connector 20 can be easily found.

In the above-described embodiment, an example in which four wafer connectors 20 are fitted to one fitting connector 10 has been described. However, the number of wafer connectors fitted to one fitting connector may be two, three, or five or more, and can be appropriately changed. Further, in the above-described embodiment, an example in which the fitting connector 10 of the connector assembly 1 is a board-mounted connector has been described. However, the fitting connector according to the present disclosure may be a connector other than the board-mounted connector, and may be, for example, a relay connector that connects one electrical connector and another electrical connector to each other.

REFERENCE SIGNS LIST

10: Fitting connector, 10*b*: Concave portion, 10*c*, 10*f*, 44*b*: Hole portion, 10*d*: Engaged portion, 11: Contact, 12: Open end, 13*a*: Receiving cavity (First receiving cavity, Second receiving cavity), 14: First side wall, 15: Second side wall, 16: Third side wall, 17: Fourth side wall, 18*b*, 19: Convex portion, 20, 20A, 20B: Wafer connector (First wafer connector, Second wafer connector) 25: Latch engaging portion, 26: Protruding portion, 27: Flexible arm, 28: Latch portion, 29: Pressing portion, 30: Terminal, 40: Wafer, 41: Cavity, 41*a*: Opening, 43: First end surface, 44: Second end surface, 45: First side surface, 46: Second side surface, 47: First base portion, 47*b*: Protrusion, 48: Second base portion, 48*b*: Opening, 49*b*, 49*h*: Engaging portion (First engaging portion, Second engaging portion), d1, d2: Disengagement distance, p1, p2: Width, t1, t2: Interval

What is claimed is:

1. A wafer connector of a stacked type configured to be electrically fitted to a fitting connector, the wafer connector comprising:

a wafer with an electrical insulation, defining a cavity configured to receive a terminal in the wafer;

a latch engaging portion including an engaging portion, being integrally formed with the wafer, and including a flexible arm configured to move between a latch engagement position at which the wafer connector is latch-engaged to the fitting connector and a latch disengagement position at which the wafer connector is unlatched from the fitting connector, wherein in a case where a first of the wafer connector is stacked with a second of the wafer connector including a second of the latch engaging portion including a second of the flexible arm, when a first of the flexible arm moves between the latch engagement position and the latch disengagement position in a state where a first of the engaging portion of the first of the wafer connector is engaged with a second of the engaging portion of the second of the wafer connector, the second of the flexible arm also moves between the latch engagement position and the latch disengagement position.

2. The wafer connector according to claim 1, wherein the first of the engaging portion is one of a convex portion and a concave portion, and the second of the engaging portion is the other of a convex portion and a concave portion.

3. The wafer connector according to claim 1, wherein the wafer includes at least one protrusion extending outward from the wafer, when the second of the wafer connector is stacked on the first of the wafer connector, the at least one protrusion is inserted into at least one opening of the second of the wafer connector, and by the at least one protrusion being inserted into the at least one opening, relative rotation between the first of the wafer connector and the second of the wafer connector is suppressed.

4. The wafer connector according to claim 1, wherein the first of the wafer connector and the second of the wafer connector that are stacked are configured to be fitted to the fitting connector, and the first of the latch engaging portion and the second of the latch engaging portion are configured to be latch-engaged with the fitting connector, and when one of the first of the wafer connector and the second of the wafer connector that are stacked is unlatched from the fitting connector, the other of the first of the wafer connector and the second of the wafer connector that are stacked is also unlatched from the fitting connector.

5. The wafer connector according to claim 1, wherein the wafer includes a first base portion and a second base portion, extending between a first side surface and a second side surface facing each other and extending between a first end surface and a second end surface facing each other, the latch engaging portion extends from one of the first side surface and the second side surface, the cavity is defined between the first base portion, the second base portion, the first side surface, the second side surface, the first end surface, and the second end surface, the wafer is configured to receive an external terminal inserted into at least one opening defined in the first end surface, and the second end surface defines at least one hole portion configured to fit to the fitting connector, and receives a contact of the fitting connector via the hole portion.

6. A fitting connector defining a plurality of receiving cavities configured to receive a plurality of wafer connectors, the fitting connector comprising an engaged portion configured to engage with a latch portion of the wafer connector received in each of the receiving cavities, wherein the wafer connector is configured to be unlatched from the fitting connector by moving the latch portion by a disengagement distance, and for two of the wafer connectors received in each of at least a first of the receiving cavities and a second of the receiving cavities among the plurality of receiving cavities, a first of the disengagement distance when the latch portion of a first of the wafer connector is moved in the first of the receiving cavities is different from a second of the disengagement distance when the latch portion of a second of the wafer connector is moved in the second of the receiving cavities.

7. The fitting connector according to claim 6, wherein by a shape of an engaged portion of the first of the receiving cavities differing from a shape of an engaged portion of the second of the receiving cavities, the first of the disengagement distance is different from the second of the disengagement distance.

8. The fitting connector according to claim 6, wherein the wafer connector includes a flexible arm including the latch portion, and when an interval between the engaged portion of the first of the receiving cavities and the flexible arm when the first of the wafer connector is received in the first of the receiving cavities is defined as t1, and when an interval between the engaged portion of the second of the receiving cavities and the flexible arm when the second of the wafer connector is received in the second of the receiving cavities is defined as t2, t2 is different from t1.

9. The fitting connector according to claim 8, wherein the value of t2 is 0.

10. The fitting connector according to claim 6, wherein the fitting connector includes a plurality of contacts configured to abut terminals of the wafer connector, and the plurality of contacts are disposed within the plurality of receiving cavities.

11. The fitting connector according to claim 6, wherein the first of the receiving cavities is an end-side receiving cavity disposed adjacent a first side wall of the fitting connector, and the second of the receiving cavities is a center-side receiving cavity away from the first side wall and a second side wall facing to the first side wall.

12. A fitting connector defining a plurality of receiving cavities configured to receive a plurality of wafer connectors, wherein the receiving cavities include receiving cavities on the end sides adjacent to side walls facing each other, and receiving cavities on the center-side disposed between the receiving cavities on a pair of the end sides, each of the receiving cavities is configured to receive the wafer connector and includes an engaged portion configured to engage with a latch portion of the wafer connector, and the engaged portions extend along the side walls facing each other, and a relationship between a width p1 of the engaged portions on each end side and a width p2 of the engaged portions on each center side satisfies $p1<p2$.

* * * * *